US008317282B2

(12) United States Patent
Satoh et al.

(10) Patent No.: US 8,317,282 B2
(45) Date of Patent: Nov. 27, 2012

(54) IMAGE FORMING APPARATUS AND RECORDING MEDIUM

(75) Inventors: Yoshiaki Satoh, Kanagawa (JP); Yuuichiroh Tsujiguchi, Kanagawa (JP); Yasumasa Mihara, Kanagawa (JP); Tomokazu Tsuchiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 280 days.

(21) Appl. No.: 12/876,667

(22) Filed: Sep. 7, 2010

(65) Prior Publication Data

US 2011/0063344 A1 Mar. 17, 2011

(30) Foreign Application Priority Data

Sep. 11, 2009 (JP) ..... 2009-210727
Jan. 9, 2010 (JP) ..... 2010-003459

(51) Int. Cl.
*B41J 2/195* (2006.01)

(52) U.S. Cl. ..... 347/7

(58) Field of Classification Search ..... 347/7, 19, 347/84, 85
See application file for complete search history.

(56) References Cited

U.S. PATENT DOCUMENTS 6,168,268 B1 * 1/2001 Sugiyama ..... 347/89
7,734,773 B2 6/2010 Tsujiguchi
7,748,808 B2 * 7/2010 Umeda et al. ..... 347/7
2008/0225070 A1 9/2008 Morishita et al.
2009/0231367 A1 9/2009 Tsuchiya
2010/0067934 A1 3/2010 Mihara et al.
2010/0194795 A1 8/2010 Tsuchiya et al.

FOREIGN PATENT DOCUMENTS

JP 2003-320686 11/2003
JP 2007-130979 5/2007
JP 4228242 12/2008

* cited by examiner

*Primary Examiner* — An Do

(74) *Attorney, Agent, or Firm* — Oblon, Spivak, McClelland, Maier & Neustadt, L.L.P.

(57) ABSTRACT

An image forming apparatus includes a head to eject liquid droplets, a sub-tank having a container to store an amount of liquid supplied to the head, a negative pressure generator unit generating a negative pressure and an air introducing mechanism to introduce air, a main-tank to supply the amount of liquid into the sub-tank, a pressure detector unit to detect a pressure inside the sub-tank, and a controller to control an image forming operation using a remaining amount of liquid in the sub-tank while the main-tank is at an end status, where the controller determines whether the pressure inside the sub-tank is within a normal range, causes, if the detected pressure is not within the normal range, the air introducing mechanism to introduce air to raise the pressure inside the sub-tank, and causes the head to eject non-image forming liquid to cause the pressure to fall within the normal range.

8 Claims, 23 Drawing Sheets

HIGH AMBIENT TEMPERATURE

STANDARD AMBIENT TEMPERATURE

LOW AMBIENT TEMPERATURE

FIG.18 aaa@aa.aa.co.jp
2006/07/10 16:21

To: xxx@yy.co.jp cc:

Subject: Device Alert Notification: Ink almost empty

Printer:
Ink almost empty
Details:
Ink almost empty: Yellow

Model: IPSiO GX 5000
Comments:
TPC/IP(Ethernet)
Host name: SAMPLE
IPv4 address: 111.111.111.111
Physical address: 00:00:AA:AA:AA:AA
Domain name:
Apparatus status display
(Ethernet): http://111.111.111.111/index.html

IMAGE FORMING APPARATUS AND RECORDING MEDIUM

BACKGROUND OF THE INVENTION

1. Field of the Invention

The invention generally relates to an image forming apparatus. Specifically, the invention relates to an image forming apparatus having a recording head to eject liquid droplets and a sub-tank to supply a liquid to the recording head, and also to a computer readable recording medium having a computer program including sets of instructions for causing a computer to implement various processes of the image forming apparatus such as an urgent printing operation to use up ink in the sub-tank, a pressure detecting process to detect the pressure inside the sub-tank, and an ink consumption measuring process to measure an consumed amount of ink.

2. Description of the Related Art

An inkjet recording apparatus is generally known as an inkjet image forming apparatus having a liquid ejecting head (inkjet head or recording head) for ejecting ink droplets. Examples of such an inkjet image forming apparatus having the inkjet head include image forming apparatuses having a function of a printer, a facsimile machine, or a plotter, or a combination of these functions. The inkjet image forming apparatus having the inkjet head is configured to eject ink droplets from the inkjet head onto a transferred sheet to form an image. The formation of the image also includes recording, printing, and imaging. There are two types of the inkjet image forming apparatus including 1) a serial type image forming apparatus in which the inkjet head ejects ink droplets onto the sheet to form an image while traveling in a main-scanning direction; and 2) a line type image forming apparatus in which the inkjet head ejects ink droplets onto the sheet to form an image without traveling. Note that the sheet is not limited to paper but includes any media including an OHP insofar as ink droplets or other liquid can be adhered to the media. Such media are also referred to as a subject recording medium or a recording medium, a recording sheet, and a recording form.

Note that in this application, the "inkjet image forming apparatus" indicates an image forming apparatus that forms an image onto media such as paper, string, fiber, fabric, leather, metal, plastic, glass, wood, and ceramics by ejecting liquid onto such media. Note also that "forming an image" or "image formation" not only indicates providing an image having some kind of meanings onto the media such as characters and symbols, but also indicates an image without having any meanings such as patterns (i.e., by simply ejecting ink droplets onto the media). Further, "ink" is not limited to those generally called "ink", but includes the name "ink" used as a generic name for liquid capable of forming an image such as recording liquid, fixing liquid, and "liquid". The ink in this application also indicates DNA specimens, resist, patterning material, resin, and the like. Moreover, the "image" is not limited to the image applied to a two-dimensional object but includes the image applied to a three-dimensional object and the image formed of a molded object.

In such image forming apparatuses, an image forming apparatus having a detachably attached main-tank and a sub-tank (may also called a "head-tank" or a "buffer-tank") configured to supply ink to a recording head via the main-tank is widely known.

For example, Japanese Patent Application Laid-Open Publication No. 2007-130979 discloses an image forming apparatus capable of controlling a sub-tank to replenish a recording head with ink. The image forming apparatus includes a suctioned amount measuring unit to measure an amount of content suctioned from the sub-tank, an air amount measuring unit to measure an amount of air in the sub-tank and an ink amount measuring unit to measure an amount of ink in the sub-tank, where a negative pressure is generated by suctioning an appropriate amount of ink or air in the sub-tank.

In general, when an ink cartridge is run out (ink end status) or almost run out (ink near end status), the image forming apparatus requests a user to replace the ink cartridge. However, if the required cartridge is out of stock, the desired ink cartridge is not immediately replicable and hence printing may not be able to continue.

SUMMARY OF THE INVENTION

Accordingly, embodiments of the present invention may provide a novel and useful image forming apparatus capable of continuing printing by controlling a sub-tank despite the fact that the main-tank is at a near-end status or at an end status, which solves one or more of the problems discussed above.

In one embodiment, there is provided an image forming apparatus that includes a recording head configured to eject liquid droplets; a sub-tank having a liquid container configured to store an amount of a liquid to be supplied to the recording head, a negative pressure generator unit configured to generate a negative pressure inside the sub-tank and an air introducing mechanism configured to introduce outside air into the liquid container; a main-tank containing the liquid and configured to supply the amount of the liquid into the sub-tank; a pressure detector unit configured to detect a pressure inside the sub-tank; a controller configured to control an image forming operation using a remaining amount of the liquid in the sub-tank while the main-tank is at an end status. In the image forming apparatus, the controller determines whether the pressure inside the sub-tank detected by the pressure detector unit is within a predetermined normal range, causes, if the detected result of the pressure inside the sub-tank is not within the predetermined normal range, the air introducing mechanism of the sub-tank to open and introduce outside air into the sub-tank to raise the pressure inside the sub-tank, and causes the recording head to carry out non-image forming liquid droplet ejection to control a negative pressure generating operation to cause the pressure inside the sub-tank to fall within the normal range.

In another embodiment, there is provided a computer-readable recording medium having a computer program embedded therein for causing a computer to execute method steps of an image forming apparatus, the image forming apparatus having a main tank containing a liquid and a sub-tank, The method includes supplying the amount of the liquid into the sub-tank from the main-tank, detecting a pressure inside the sub-tank, and controlling an image forming operation using a remaining amount of the liquid in the sub-tank while the main tank is at an end status. The controlling step further includes determining whether the detected pressure inside the sub-tank is within a predetermined normal range, opening, if the detected result of the pressure inside the sub-tank is not within the predetermined normal range, an air introducing mechanism of the sub-tank to introduce outside air into the sub-tank to raise the pressure inside the sub-tank, and causing a recording head to carry out non-image forming liquid droplet ejection to control a negative pressure generating operation to cause the pressure inside the sub-tank to fall within the normal range.

BRIEF DESCRIPTION OF THE DRAWINGS

Other objects and further features of embodiments will be apparent from the following detailed description when read in conjunction with the accompanying drawings, in which:

FIG. 18 is a view illustrating an example of an error massage report sent via an email;

DESCRIPTION OF THE PREFERRED EMBODIMENTS

In the following, preferred embodiments of the present invention will be described with reference to the accompanying drawings.

First Embodiment

Figure 1:
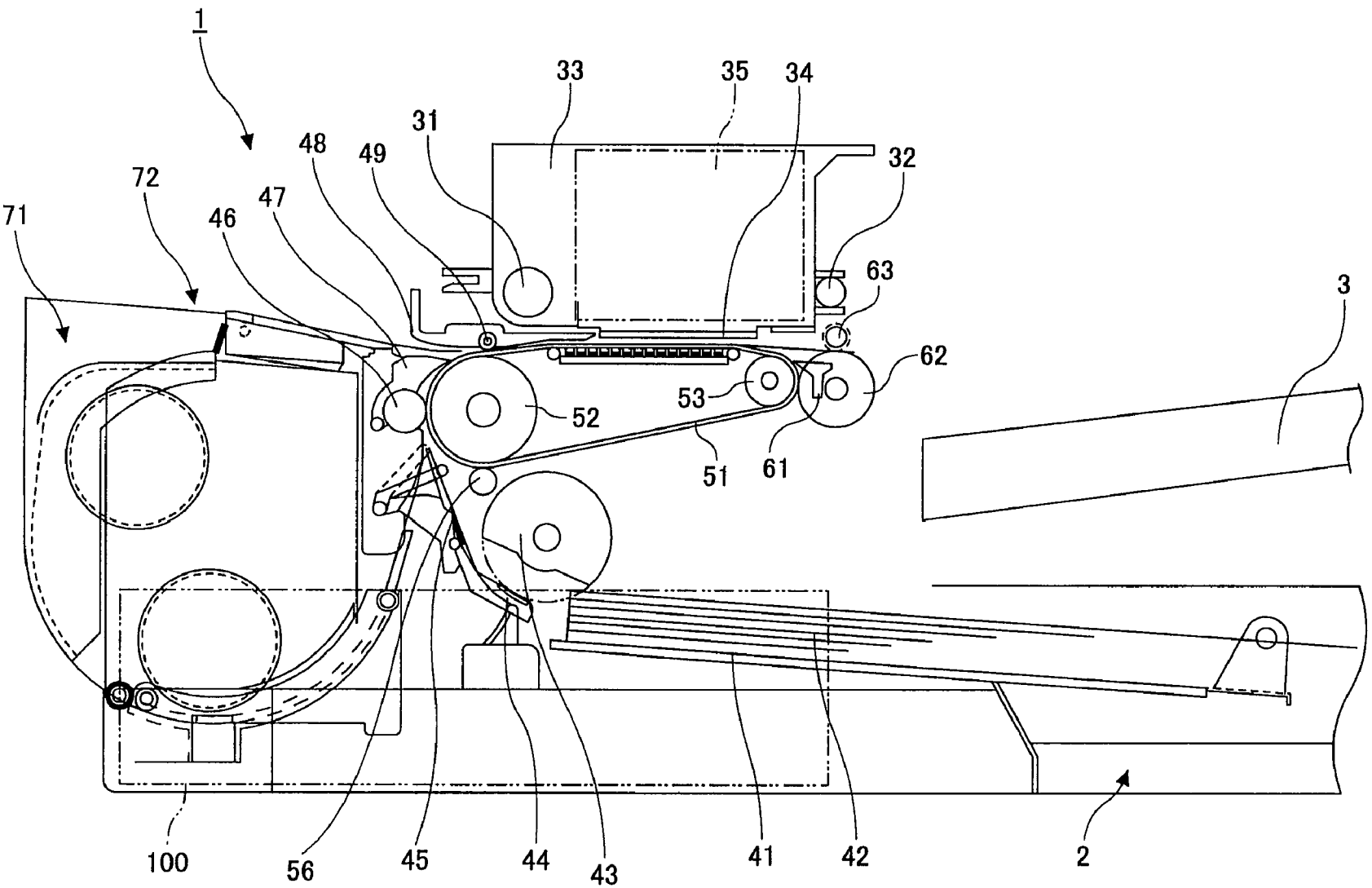
FIG. 1 is a side view of an overall configuration diagram illustrating a mechanical unit of an image forming apparatus according to a first embodiment.
Figure 2:
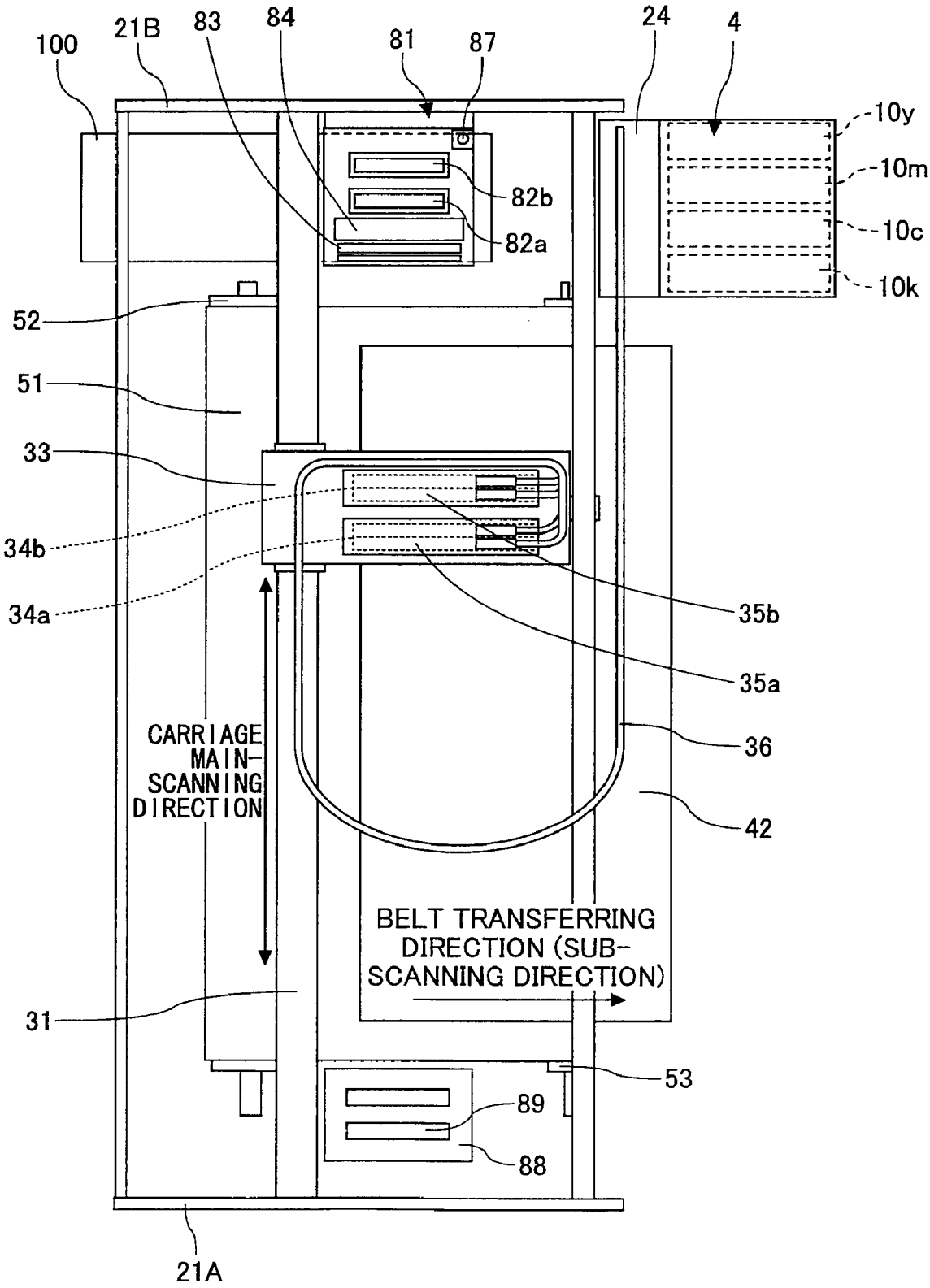
FIG. 2 is a plan view illustrating main components of the mechanical unit of the image forming apparatus according to the first embodiment.

First, an example of an image forming apparatus according to a first embodiment is described with reference to FIGS. 1 and 2. Note that FIG. 1 is a side view of the image forming apparatus illustrating its entire configuration, and FIG. 2 is a plan view of main components of a mechanical unit of the image forming apparatus. The image forming apparatus is a serial inkjet recording apparatus. As illustrated in FIG. 2, the recording apparatus (image forming apparatus) includes side plates 21A and 21B located at both sides of a main body 1, a guide member composed of a guiding rod 31 and a guided rod 32 placed across the side plates 21A and 21B to slidably support a carriage 33 in a carriage main-scanning direction, and a not-shown main-scanning motor to move the carriage 33 via a timing belt to scan in the carriage main-scanning direction.

The carriage 33 includes a recording head 34 composed of two recording heads 34*a* and 34*b*. The recording heads 34*a* and 34*b* include nozzle arrays composed of plural nozzles arranged in a sub-scanning direction perpendicular to the main scanning direction, and the respective ink droplet ejecting directions of the nozzles are downwardly directed for ejecting yellow (Y) ink, cyan (C) ink, magenta (M) ink, and black (K) ink.

The recording heads 34*a* and 34*b* each have two nozzle arrays. The recording head 34*a* includes a first nozzle array to eject black (K) ink droplets and a second nozzle array to eject cyan (C) ink droplets, whereas the recording head 34*b* includes a first nozzle array to eject magenta (M) ink droplets and a second nozzle array to eject yellow (Y) ink droplets.

The carriage 33 includes a sub-tank 35 composed of sub-tanks 35*a* and 35*b* as a second ink supplier to supply respective colors of ink to the corresponding nozzle arrays of the recording heads 34*a* and 34*b* (or recording head 34). The sub tank 35 having the sub tanks 35*a* and 35*b* is supplied with recording liquid of respective colors via supply tubes 36 for corresponding colors by a supply pump unit 24 from ink cartridges (main-tanks) 10*y*, 10*m*, 10*c*, and 10*k* of respective colors that are detachably attached to a cartridge application unit 4.

The recording apparatus further includes a semicircular feeding roll 43 and a separation pad 44 made of a material having a high friction coefficient and directed to face the feeding roller 43. The feeding roll 43 and the separation pad 44 are used as a sheet-feeding unit for feeding sheets 42 accumulated on a sheet accumulating unit (platen) 41 of a feed tray 2. The sheet-feeding unit composed of the feeding roller 43 and the separation pad 44 is configured to feed one sheet 42 each from the sheet accumulating unit 41, and the separation pad 44 is biased toward the feeding roller 43 side.

The recording apparatus further includes a guide member 45 for guiding the sheet 42, a counter roller 46, a transfer guide member 47, an edge-pressing roll 49, and a presser member 48 in order to transfer the sheet 42 fed from the sheet-feeding unit to a lower side of the recording head 34. The recording apparatus also includes a transfer belt 51 to electrostatically attract the sheet 42 to transfer the sheet 42 at a position facing the recording head 34.

The transfer belt 51 is looped over a transfer roller 52 and a tension roller 53 so as to rotationally travel in a belt transferring direction (sub-scanning direction). The recording apparatus further includes a charging roller 56 to charge a surface of the transfer belt 51. The charging roller 56 is configured to be brought into contact with the surface layer of the transfer belt 51 and be rotationally driven by the rotation of the transfer belts 51. The transfer belt 51 rotationally travels in the belt transferring direction by the transfer roller 52 that is rotationally driven by a later-described sub-scanning motor via the timing belt.

The recording apparatus further includes a sheet-discharging unit including a separation claw 61 for separating the sheet 42 from the transfer belt 51, a sheet-discharge roller 62, a spur (sheet-discharge roll) 63, and a sheet-discharge tray 3 located at a lower side of the sheet-discharge roller 62.

The recording apparatus also includes a duplex printing unit 71 detachably attached at the back of the main body 1. The duplex printing unit 71 captures the sheet 42 rotationally transferred in a reverse direction of the transfer belt 51, reverses the sheet 42, and then feed the reversed sheet 42 between the counter roller 46 and the transfer belt 51. The recording apparatus also includes a manual bypass tray 72 on top of the duplex printing unit 71.

The recording apparatus further includes a retaining-recovery mechanism 81 for retaining and recovering the nozzle states of the recording head 34 in a non-printing region at one side of the carriage 33 in the carriage main-scanning direction. The retaining-recovery mechanism 81 includes cap members 82*a* and 82*b* (hereinafter called "caps 82*a*, 82*b*" or simply called "caps 82") for capping the respective nozzle faces of the recording head 34, a wiper member (wiper blade) 83 for wiping the nozzle faces, a non-printing ink ejection liquid ejection receiver 84 for receiving non-printing ink ejection liquid when the recording liquid is thickened and thus discharged, and a carriage lock 87 for locking the carriage 33. The recording apparatus also includes a replaceable waste tank 100 attached at a lower side of the retaining-recovery mechanism 81 of the recording head 34 to store waste liquid discharged by retaining-recovery operations.

The recording apparatus further includes a non-printing ink ejection liquid ejection receiver 88 in a non-printing region at the other side of the carriage 33 in the carriage main-scanning direction so as to receive the non-printing ink ejection liquid. Note that the non-printing ink ejection liquid discharged to the non-printing ink ejection liquid ejection receiver 88 is the recording liquid that is thickened (thus clogged) while printing (recording) is carried out. The non-printing ink ejection liquid ejection receiver 88 includes an opening 89 along the nozzle array direction of the recording head 34.

In the image forming apparatus (recording apparatus) having the above configuration, each sheet 42 is separated from those in the feed tray 2, the sheet 42 is approximately vertically arranged to be guided by the guide member 45, the sheet 42 is sandwiched between the transfer belt 51 and the counter roller 46 to be transferred, the edge of the sheet 42 is guided by the transfer guide member 47, and pressed against the transfer belt 51 by the edge-pressing roll 49, and then the transfer direction of the sheet 42 is changed at approximately 90 degrees.

In this process, voltages are alternately applied to the charging roller 56 to output plus and minus charges so that the transfer belt 51 is charged with alternate charge voltage patterns by the charging roller 56. That is, the transfer belt 51 is alternately charged with a predetermined plus or a minus band-like width in a transfer belt rotational direction (i.e., sub-scanning direction). When the sheet 42 is fed onto the transfer belt 51 alternately charged with plus and minus charge voltage patterns, the sheet 42 is electrostatically attracted by the transfer belt 51 and then transferred in the sub-scanning direction by rotational traveling of the transfer belt 21.

The recording head 34 is driven while moving the carriage 33 based on the image signals so as to eject ink droplets onto the stationary sheet 42, thereby recording one line of the ink droplets. The sheet 42 is then transferred by a predetermined amount, and the next line of droplets is subsequently recorded on the transferred sheet 42. The recording operation is terminated when a recording end signal is received or when a signal indicating that a rear end of the sheet 42 has reached the recording region. The sheet 42 is then discharged onto the sheet-discharge tray 3.

When the nozzles of the recording head 34 retain or recover, the carriage 33 is moved to a home position facing the retaining-recovery mechanism 81, where the retaining-recovery operations such as non-printing ink ejection operation, capping of the nozzles with the caps 82, and suctioning the non-recording liquid from the nozzles are carried out. As a result, ink is stably ejected onto the sheet 42 to form an image.

Figure 3:
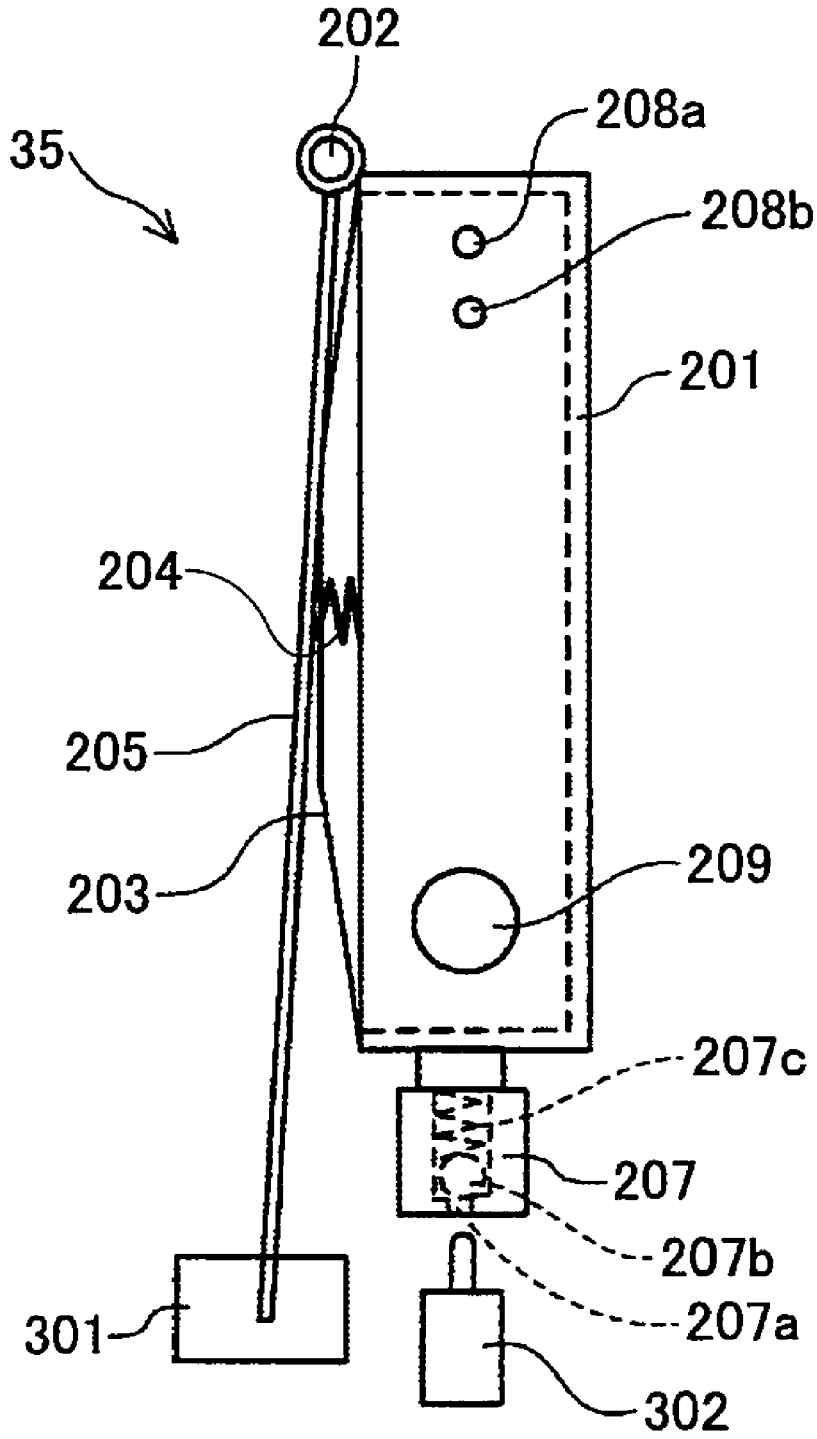
FIG. 3 is a schematic plan view illustrating one example of a sub-tank placed in the mechanical unit of the image forming apparatus according to the first embodiment.
Figure 4:
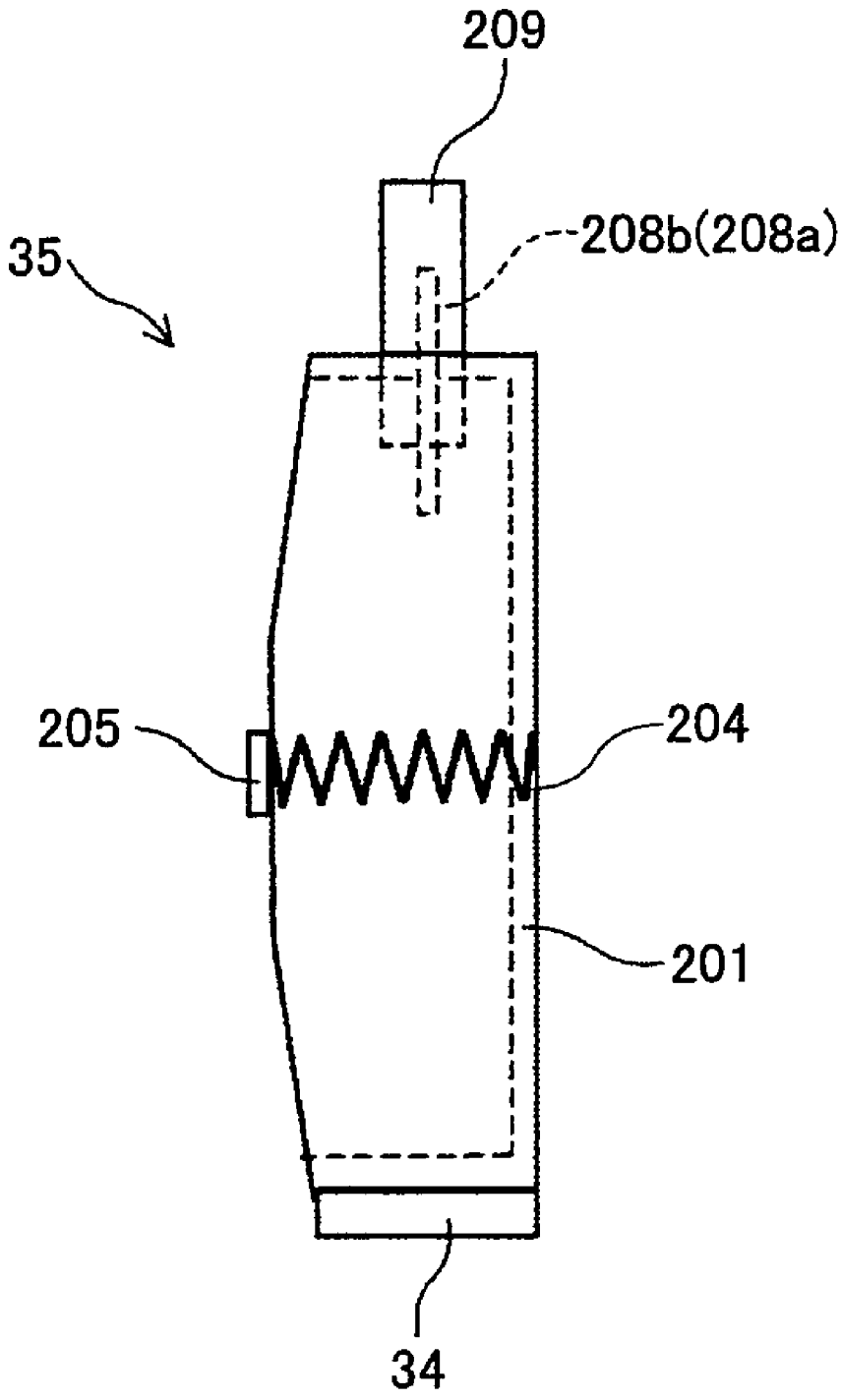
FIG. 4 is a schematic front view illustrating the example of the sub-tank of FIG. 3.

Next, an example of the sub-tank 35 is described with reference to FIGS. 3 and 4. Note that FIG. 3 is a schematic top view of the sub-tank 35 for one head, and FIG. 4 is a schematic front view of the sub-tank 35 for the head. The sub-tank 35 includes a tank case 201 formed as ink container for storing ink and having an opening in one of the side plates of the tank case 201. The opening of the tank case 201 is sealed with a flexible film 203, which is constantly pressed (biased) outwardly by a spring 204 used as an elastic member inside the tank case 201. That is, outward biased force is applied to the flexible film 203 by the spring 204. Accordingly, a negative pressure is generated in the tank case 201 by a decrease of ink remaining in the tank case 201.

The sub-tank 35 also includes a displacement member (also called as "full-tank detecting filler") 205 on an outside surface the tank case 201. The displacement member 205 is pressed (biased) toward the tank case 201 and is supported by a spindle 202. The displacement member 205 is fixed on the flexible film 203 with adhesive. The displacement member 205 is moved with the movement of the flexible film 203, and a displaced amount of the displacement member 205 may be detected by an optical full-tank detecting sensor 301 arranged on the main body 1 of the recording apparatus. In this manner, ink remaining in the sub-tank 35 (i.e., remaining amount of ink) may be detected.

The tank case 201 includes an ink supply port 209 for supplying ink from the ink cartridge 10 (i.e., 10*y*, 10*m*, 10*c*, and 10*k*) in an upper outer surface of the tank case 201 and an ink supply tube 36 is connected to the ink supply port 209. The tank case 201 also includes an air introducing mechanism 207 on a side outer surface of the tank case 201 for ventilating air inside the sub-tank 35. The air introducing mechanism 207 includes a valve body 207*b* for closing or opening an air introducing path 207*a* communicated with inside the sub-tank 35 and a spring 207*c* for applying force to tightly close the valve body 207*b*. The valve body 207*b* is opened by an air introducing solenoid 302 attached to the main body 1 of the recording apparatus to ventilate air inside the sub-tank 35 (sub-tank 35 is communicated with air).

The tank case 201 also includes electrode pins 208*a* and 208*b* on the upper outer surface of the tank case 201 for detecting the height of an ink surface (level of an ink surface) inside the sub-tank 35. Ink generally has conductivity, and if the ink reaches the heights of the electrode pins 208*a* and 208*b*, the current flows between the electrode pins 208*a* and 208*b* to change their voltages. Accordingly, the electrode pins 208*a* and 208*b* detect that the height of the ink surface has been equal to or lower than a predetermined height. That is, the electrode pins 208*a* and 208*b* detect that the amount of air in the sub-tank 35 is equal to or larger than a predetermined amount.

Figure 5:
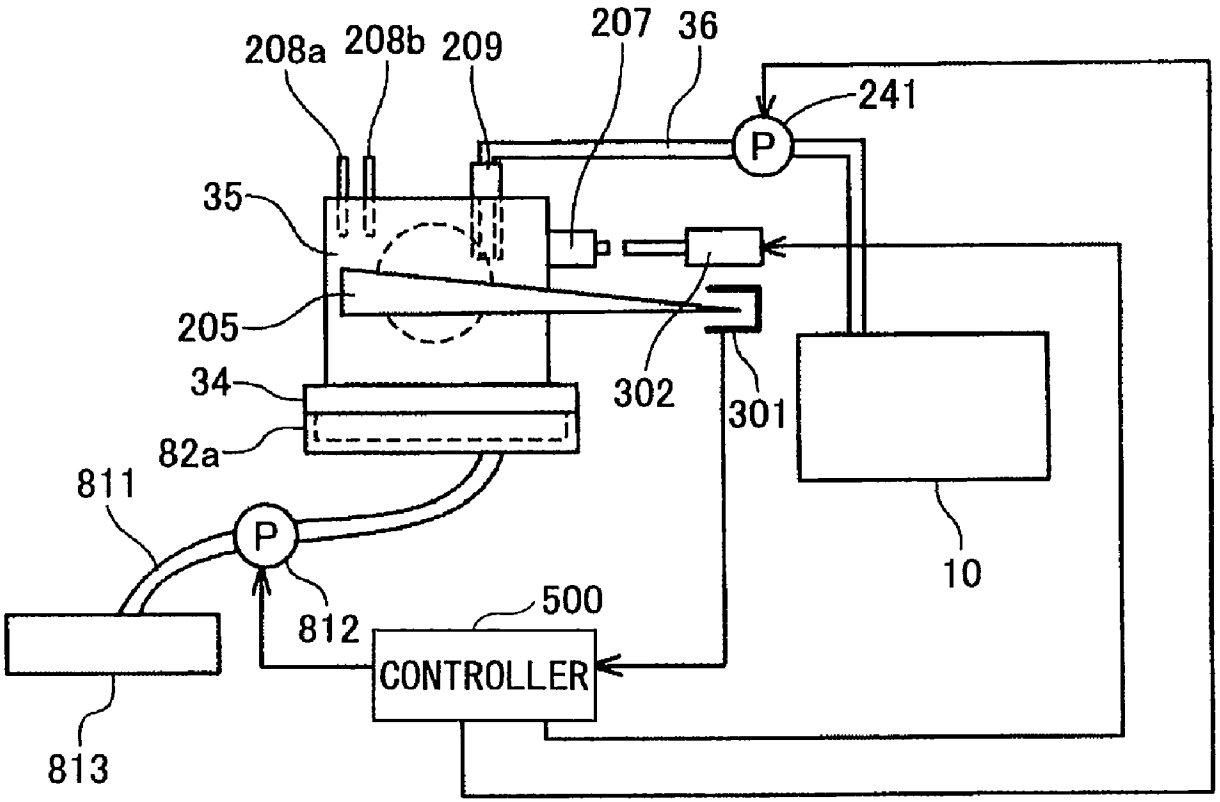
FIG. 5 is a schematic view illustrating an ink supply-discharge system.

Next, a negative pressure generated in the sub-tank 35 is described with reference to an outline of an ink supply-discharge system illustrated in FIG. 5. First, ink is supplied by an ink supply pump 241 of a supply unit from the ink cartridge 10 to the sub-tank 35 via the ink supply tube 36.

The nozzle surface of the recording head 34 is capped with a suction cap 82*a* of the retaining-recovery mechanism 81 while the air introducing mechanism 207 of the sub-tank 35 is being closed. The ink in the sub-tank 35 is suctioned by the nozzles via a suction tube 811 by driving a suction pump 812 of the retaining-recovery mechanism 81. Subsequently, the elastic member 204 presses the flexible film 203 outwardly to generate a negative pressure inside the sub-tank 35. Note that the ink suctioned from the sub-tank 35 is discharged in a waste tank 813.

The ink inside the sub-tank 35 is consumed by ejecting non-printing ink ejection liquid from the recording head 34 toward the non-printing ink ejection liquid ejection receiver 84 while the air introducing mechanism 207 of the sub-tank 35 is being closed. The flexible film 203 is outwardly pressed by the elastic member 204 to generate a negative pressure in the sub-tank 35.

Figure 6:
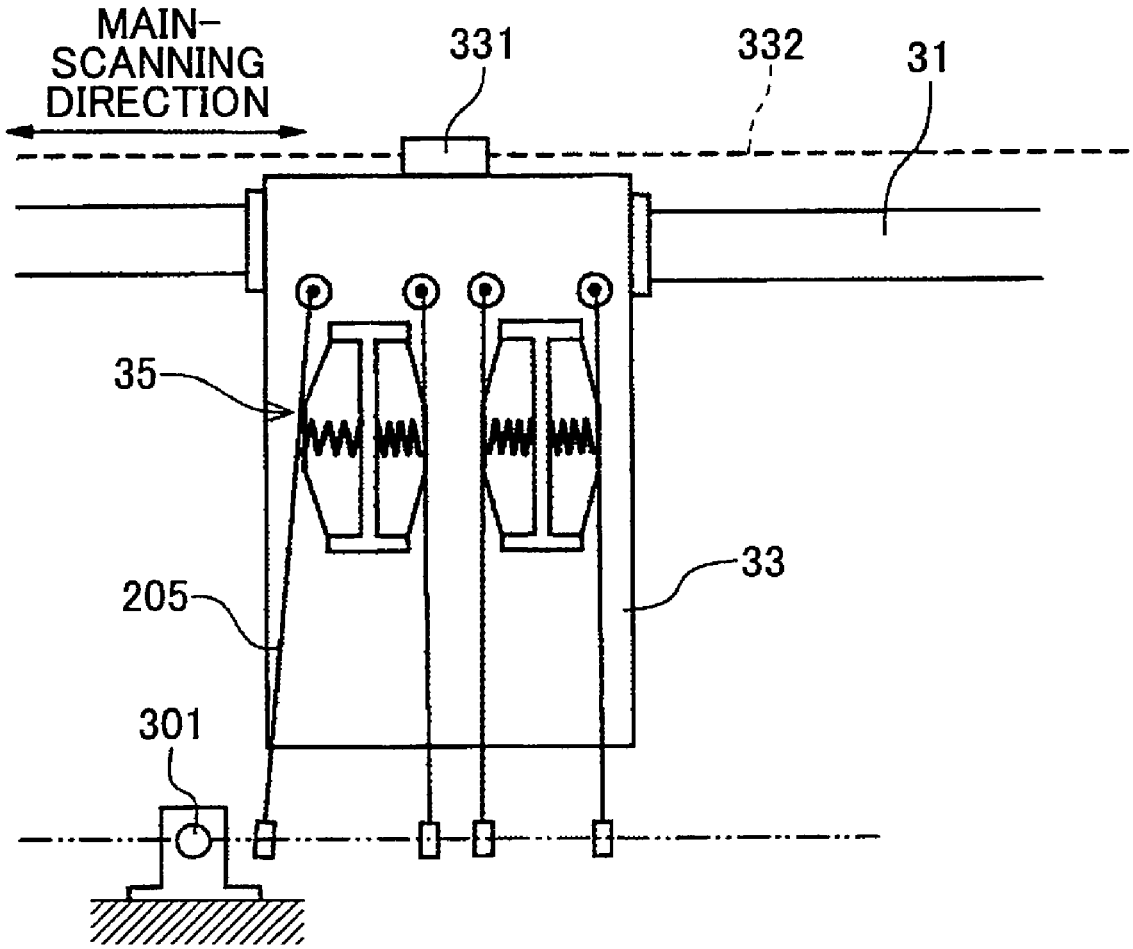
FIG. 6 is a view illustrating a main section of a sub-tank pressure detector unit including a full-tank detecting sensor and a carriage.

Next, detection of the negative pressure in the sub-tank 35 is described with reference to FIGS. 6 and 7. As illustrated in FIG. 6, the main body 1 of the recording apparatus includes the optical full-tank detecting sensor 301 at a position where the displacement member (full-tank detecting filler) 205 passes through while the carriage 33 travels in the main-scanning direction. Note that a (current) position of the carriage 33 in the main-scanning direction is detected by allowing an encoder sensor 331 to read an encoder scale 332 arranged in the carriage main-scanning direction.

Figure 7B:
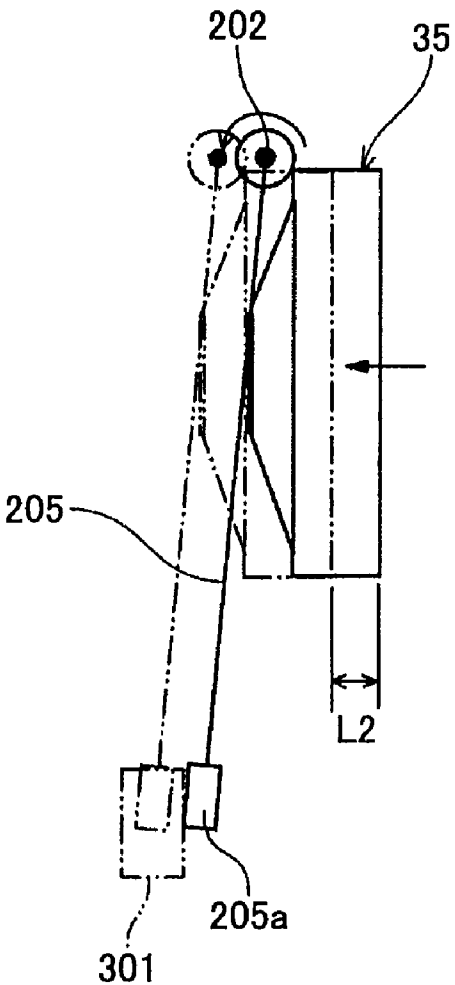
FIGS. 7A and 7B are schematic views illustrating the sub-tank pressure detector unit.
Figure 7A:
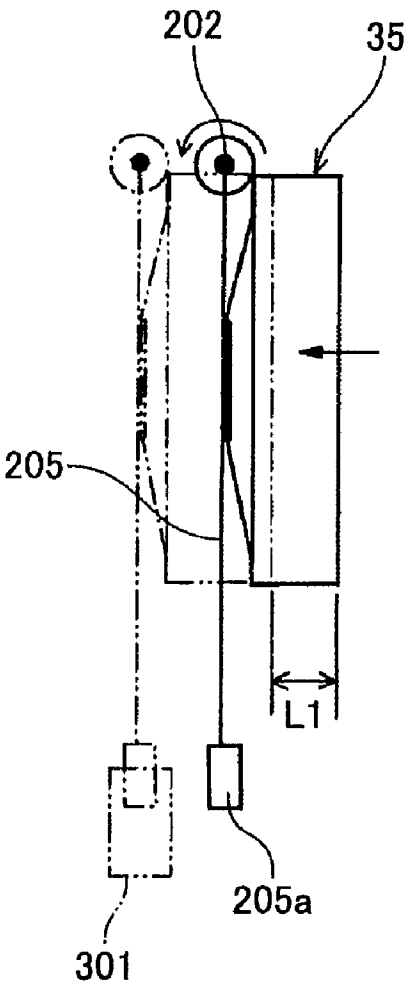

Accordingly, as illustrated in FIG. 7A, when the negative pressure in the sub-tank 35 is normal, an edge 205*a* of the displacement member 205 is detected by the full-tank detecting sensor 301 while the sub-tank 35 is moved a distance L1 by moving the carriage 33 from a predetermined position indicated by a solid line to a position indicated by an arrow.

In contrast, as illustrated in FIG. 7B, when the negative pressure in the sub-tank 35 is abnormal, the displacement member 205, which is originally moved to the sub-tank 35 side, is located at a position distant from the sub-tank 35. That is, the elastic member 204 is outwardly pressed by restoring force. When the carriage 33 is moved from the predetermined position indicated by the solid line to the position indicated by the arrow in the same manner as above, the sub-tank 35 is moved a distance L2 shorter than the distance L1 in an amount of which the sub-tank 35 is moved when the negative pressure in the sub-tank 35 is normal. Accordingly, the displacement member 205 is detected by the full-tank detecting sensor 301 when sub-tank 35 is moved the distance L2.

Thus, a displaced amount of the displacement member 205 (corresponding to a displacement amount of the elastic member 204 in the sub-tank 35) and the pressure inside the sub-tank 35 are detected by detecting the position (displacement distance) of the sub-tank 35 when the displacement member 205 is detected. Further, since the displacement member 205 is displaced based on a remaining amount of ink, the remaining amount of ink is also detected by detecting the position of the sub-tank 35.

Next, an outline of a controller 500 of the image forming apparatus (recording apparatus) is described with reference to FIG. 8. Note that FIG. 5 is a block diagram illustrating an overall configuration of the controller 500 of the image forming apparatus. The control unit 500 includes a CPU 501 configured to control the entire image forming apparatus and operations of a consumption measuring unit and a pressure detecting unit, a ROM 502 configured to store a computer program to be executed by the CPU 501 and other fixed data, a RAM 503 configured to temporarily store data such as image data, a rewritable non-volatile memory 504 configured to store data regardless of the power supply of the image forming apparatus being turned on or off, and an ASIC (application-specific integrated circuit) 505 configured to process various signals for processing image data, and input and output signals for image processing such as sorting and for controlling the entire image forming apparatus.

The controller 500 further includes a print controller 508 including a data transfer unit and a drive signal generator unit for drive controlling the recording head 34, a head driver (driver IC) 509 for driving the recording head 34 provided at the carriage 33 side, a motor drive unit 510 for driving a main-scanning motor 554 to move the carriage 33 to scan, a sub-scanning motor 555 to rotationally move the transfer belt 51, a retaining-recovery motor 556 to drive the retaining-recovery mechanism 81, an AC bias supply unit 511 to supply an AC bias to the charging roller 56, a solenoid driver unit 512 for driving an air introducing solenoid 302 to open or close the air introducing mechanism 207 of the sub-tank 35.

Further, the controller 500 is connected to the operations panel 514 for inputting and displaying desired information for the image forming apparatus.

The controller 500 further includes a host IF 506 to communicate with a host side 600 for receiving and sending data and signals, such that the host IF 506 receives the data and signals via a cable or the network from the host side 600 including an information processing apparatus such as a personal computer, an image reading apparatus such as an image scanner, and an image-pickup apparatus such as a digital camera.

The CPU 501 of the controller 500 retrieves printing data from a receiving buffer in the host IF 506 to analyze the retrieved printing data, causes the ASIC 505 to carry out desired processing such as image processing or sorting data, and transfers the processed data from the print controller 508 to the head driver 509. Note that dot pattern data for outputting images are generated by a printer driver 601 located at the host side 600.

The print controller 508 serially transfers the above image data while outputting transfer clocks, latch signals, and control signals required for transferring the above image data to the head driver 509. The print controller 508 further includes a drive signal generator unit composed of a D/A converter for D/A converting pattern data of drive pulses stored in the ROM 502, a voltage amplifier, and a current amplifier to output a drive signal composed of one or more drive pulses to the head driver 509.

The head driver 509 generates ejecting pulses by selecting the drive pulses forming a drive signal supplied from the print controller 508 based on the image data corresponding to one line of the image data serially input to the recording head 34. The head driver 509 then applies the generated ejecting pulses to driving elements such as the piezoelectric members 121 to generate energy for ejecting liquid droplets, thereby driving the recording head 34. In this process, different sizes of dots (liquid droplets) such as large, medium, small sized droplets may be formed by selecting the drive pulses constituting the drive signal.

An input-output (I/O) unit 513 acquires information from a sensor group 515 having various sensors attached to the image forming apparatus, selects desired information for controlling the printer to apply the acquired information for controlling the print controller 508, the motor drive unit 510, and the AC bias supply unit 511. The sensor group 515 includes optical sensors to detect positions of the sheet, a thermistor to monitor the temperature and humidity within the apparatus, sensors to monitor the voltage of the charging belt, and an interlock switch to detect open or close state of a cover. The I/O unit 513 is configured to process various kinds of sensor information. Note that the sensor group 515 that supplies various types of information to the I/O unit 513 is supplied with signals sent from the full-tank detecting sensor 301 to detect the displacement member 205 of the sub-tank 35 and the electrode pins 208*a* and 208*b* for detecting level of the ink surface.

As described above, the CPU 501 of the controller 500 includes a pressure detector unit configured to detect pressure inside the sub-tank 35 by detecting a position of the displacement member 205 based on the detected signal sent from the full-tank detecting sensor 301. A rewritable storage unit (memory) capable of retaining data or information when the apparatus is shut down such as battery backup RAM or an NVRAM (i.e., nonvolatile RAM) 504 is used as a storage unit to store the ambient temperature and humidity of the image forming apparatus obtained based on the detected signals obtained by a temperature sensor or a humidity sensor of the sensor group 515.

Next, a printing control process including printing by using up a remaining ink in the sub-tank 35 when the amount of ink in a main-tank of the image forming apparatus is at an ink end status. First, whether a current status of printing is normal printing, urgent printing, or ink-use-up urgent printing is determined (step S1). Note that the "normal printing" indicates an image forming operation where printing is carried out using ink contained in the sub-tank 35 while an amount of ink consumed in the sub-tank 35 (also called a "consumed amount of ink" or an ejected amount of ink) is supplied from the main-tank 10 (i.e., 10*y*, 10*m*, 10*c*, and 10*k*) that has sufficient ink. The "urgent printing" indicates an image forming operation where printing is carried out using the remaining ink contained in the sub-tank 35 when ink in the main-tank 10 (i.e., 10*y*, 10*m*, 10*c*, and 10*k*) is (almost) run out (ink end status). The "ink use-up urgent printing" indicates an image forming operation where printing is carried out by using up the remaining ink contained in the sub-tank 35 until the negative pressure generated inside the sub-tank 35 reach the maximum and is incapable of being generated any more.

When the ink use-up urgent printing is selected by a user's instruction, whether the pressure inside the sub-tank 35 is within a normal range to allow the recording head 34 to eject liquid droplets is determined by causing the displacement member (full-tank detecting filler) 205 to detect the pressure inside the sub-tank 35 (step S2). More specifically, whether the pressure inside the sub-tank 35 is within the normal range or smaller than the normal range is determined in step S2. If the pressure inside the sub-tank 35 is greater than the normal range, the result is determined as an error.

If the pressure inside the sub-tank 35 is smaller the normal range capable of ejecting liquid droplets from the recording head 34, whether the consumed amount of ink (or ejected amount of ink) is equal to or larger than a predetermined threshold, or the consumed amount of ink (or ejected amount of ink) is smaller than the predetermined threshold is determined (step S3). Note that the "consumed amount of ink" (amount of ink ejected from the recording head 34) indicates the value of a total obtained by an "amount of an ejected drop*the number of ejected drops". Note also that the "amount of an ejected drop" is a predetermined value (i.e., a predetermined amount).

In this process, if the consumed amount of ink (or ejected amount of ink) is smaller than the predetermined threshold, the air introducing mechanism 207 of the sub-tank 35 is opened and introduces outside air to the sub-tank 35 to thereby raise the pressure inside the sub-tank 35, and the air introducing mechanism 207 is then closed (step S4). Thereafter, the pressure inside the sub-tank 35 is reduced by causing the recording head 34 to carry out non-image forming liquid droplet ejection (non-printing ink ejection) (step S5). The amount of ink consumed for non-image forming liquid droplet ejection is added to the consumed amount of ink (step S6).

Meanwhile, if the pressure inside the sub-tank 35 is within the normal range in step S2, printing operation (image forming operation) is carried out by ejecting ink (step S7), and the amount of ink consumed (ejected) for image forming operation is added to the consumed amount of ink (step S8).

Further, if the consumed amount of ink is equal to or more than the predetermined threshold in step S3, the result determined as the "ink end" status is reported to the operations panel 514 or the host side 600.

Further, if the current status of printing is determined as the normal printing in step S1, an ink ejection processing in normal printing (normal ink ejection processing) is carried out (step S10).

On the other hand, if the current status of printing is determined as the urgent printing in step S1, whether the pressure inside the sub-tank 35 is within the normal range or smaller than the normal range is determined by causing the displacement member (full-tank detecting filler) 205 to detect the pressure inside the sub-tank 35 (step S11).

In this process, if the pressure inside the sub-tank 35 is within the normal range capable of ejecting liquid droplets from the recording head 34, printing operation (image forming operation) is carried out by ejecting ink (step S12), and the amount of ink consumed (ejected) for image forming operation is added to the consumed amount of ink (step S13).

Meanwhile, if the pressure inside the sub-tank 35 is smaller than the normal range in step S11, the result determined as an "ink end status but capable of carry out the ink use-up urgent printing" is reported to the operations panel 514 or the host side 600 (step S14).

Here, a position of the displacement member (full-tank detecting filler) 205 associated with the printing control process is described with reference to FIG. 10. First, if ink is ejected (for printing) in a condition (B) in FIG. 10, the pressure inside the sub-tank 35 is reduced in an amount corresponding to an amount of ink ejected (consumed), and the edge 205*a* of the displacement member (full-tank detecting filler) 205 is moved in a direction indicated by an arrow A (the main-scanning direction) as illustrated in a condition (C). This illustrates that if the ink is continuously ejected (for printing) the pressure inside the sub-tank is further lowered and the edge 205*a* of the displacement member (full-tank detecting filler) 205 is further moved in the main-scanning direction indicated by the arrow A as illustrated in the condition (C) of FIG. 10.

If ink is supplied from the ink cartridge 10 (i.e., main-tank) to the sub-tank 35 in the condition (C) (i.e., the sub-tank 35 suctions ink from the ink cartridge 10), the pressure inside the sub-tank 35 is raised in an amount corresponding to the amount of ink suctioned from the ink cartridge 10. Accordingly, the edge 205*a* of the displacement member (full-tank detecting filler) 205 is moved in a direction opposite to the direction indicated by the arrow A (the main-scanning direction) as illustrated in a condition (B).

If ink is supplied from the ink cartridge 10 (i.e., main-tank) to the sub-tank 35 in the condition (C) (i.e., the sub-tank 35 suctions ink from the ink cartridge 10) but the ink cartridge 10 is empty (ink end status), the ink is not supplied to the sub-tank 35. Accordingly, the edge 205*a* of the displacement member (full-tank detecting filler) 205 is not moved and thus remains at the same position. Thus, even if an operation to supply ink from the ink cartridge 10 is carried out, the position of the edge 205*a* of the displacement member (full-tank detecting filler) 205 is unchanged. Accordingly, the ink end status of the ink cartridge 10 may be detected. Note that the ink end status of the ink cartridge 10 may be detected based on the difference between the consumed amount of ink ejected and the capacity of the ink cartridge 10.

Further, if the air introducing mechanism 207 of the sub-tank 35 in the condition (C) is opened and introduce outside air, the pressure inside the sub-tank 35 becomes the same pressure level as the outside atmospheric pressure. That is, since the pressure inside the sub-tank 35 has a negative pressure, the pressure inside the sub-tank 35 is increased in an amount corresponding to the amount of the outside air introduced into the sub-tank 35. Accordingly, the edge 205*a* of the displacement member (full-tank detecting filler) 205 is moved in a direction indicated by an arrow B (the main-scanning direction), which is the direction opposite to that indicated by the arrow A, as illustrated in a condition (A).

Figure 10:
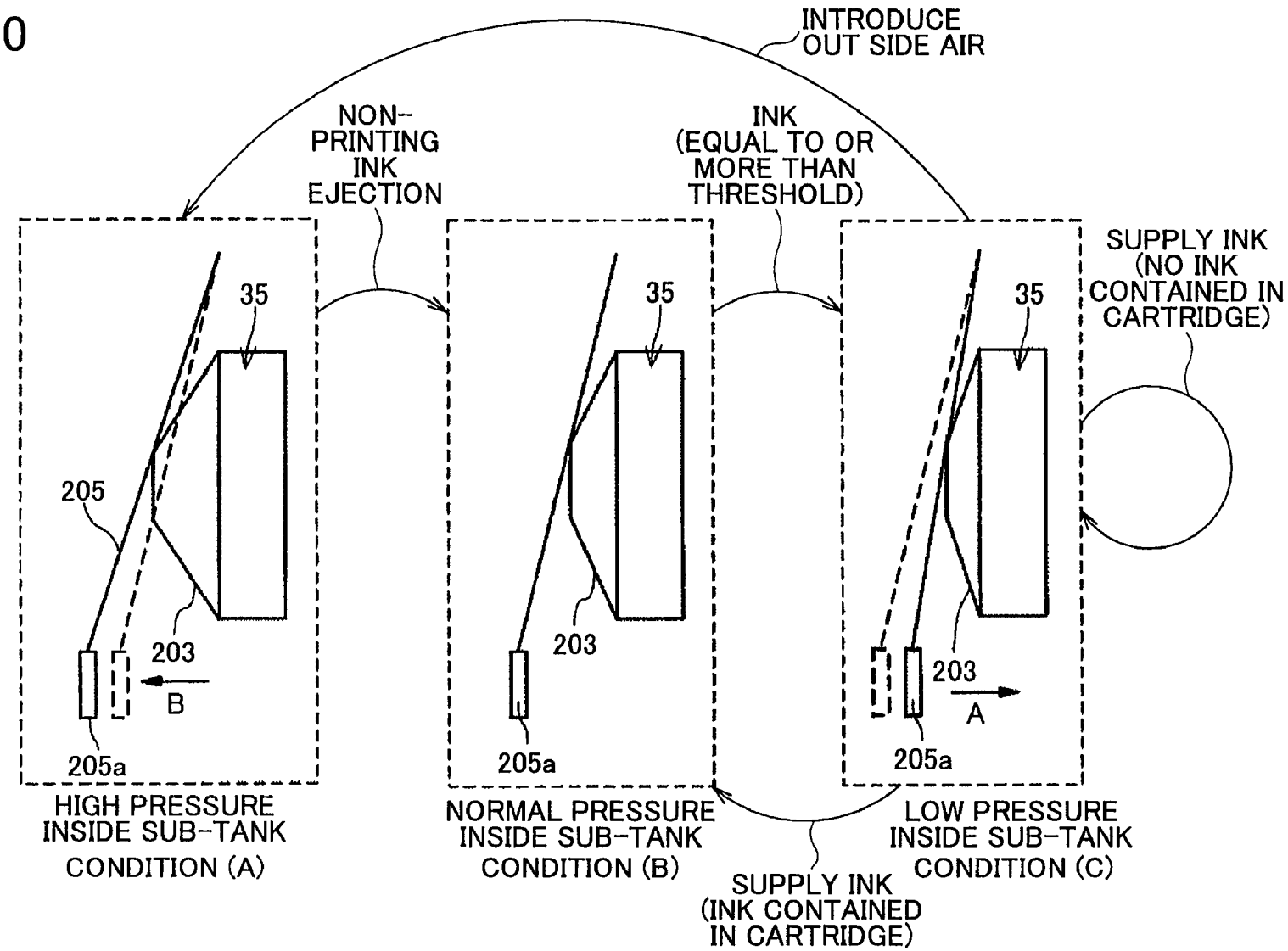
FIG. 10 is a diagram illustrating a relationship between a position of a full-tank detecting filler (displacement member) for pressure inside the sub-tank and the printing control process that is carried out by the controller.

If non-printing ink ejection is carried out in the condition (A) in FIG. 10, the pressure inside the sub-tank 35 is reduced in an amount corresponding to an amount of ink ejected (consumed) for the non-printing ink ejection, and the edge 205*a* of the displacement member (full-tank detecting filler) 205 is moved in the direction indicated by the arrow A (the main-scanning direction) as illustrated in a condition (B).

Next, the position of the displacement member (full-tank detecting filler) 205 associated with a change in an ink surface 401 of ink 400 in the sub-tank 35 is described with reference to FIGS. 11A through 11D. Note that in FIGS. 11A through 11D, left side portions of the diagrams FIGS. 11A to 11D indicate front views of the sub-tank 35, central portions of the diagrams indicate side views of the sub-tank 35, and right side portions of the diagrams indicate the ink surface 401 of the ink contained in the sub-tank viewed from the front side of the sub-tank 35.

Figure 11A:
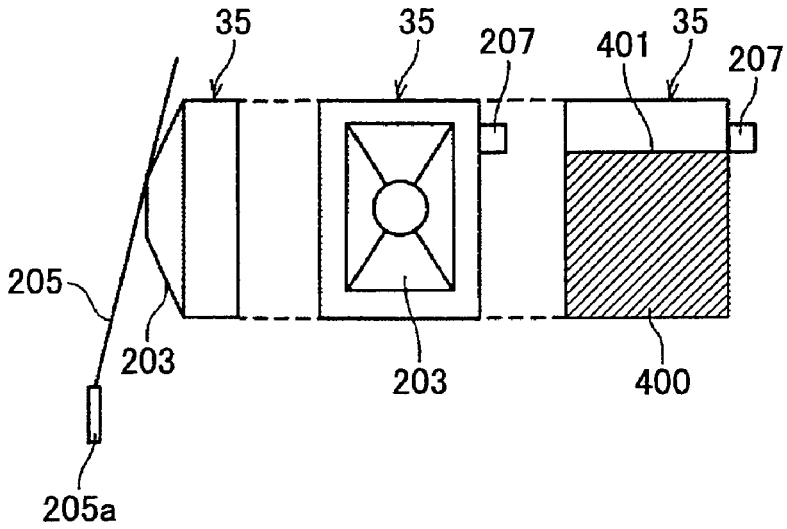
FIGS. 11A through 11D are diagrams illustrating relationships between positions of the full-tank detecting filler and a liquid surface inside the sub-tank when the printing control process is carried out by the controller.
Figure 11B:
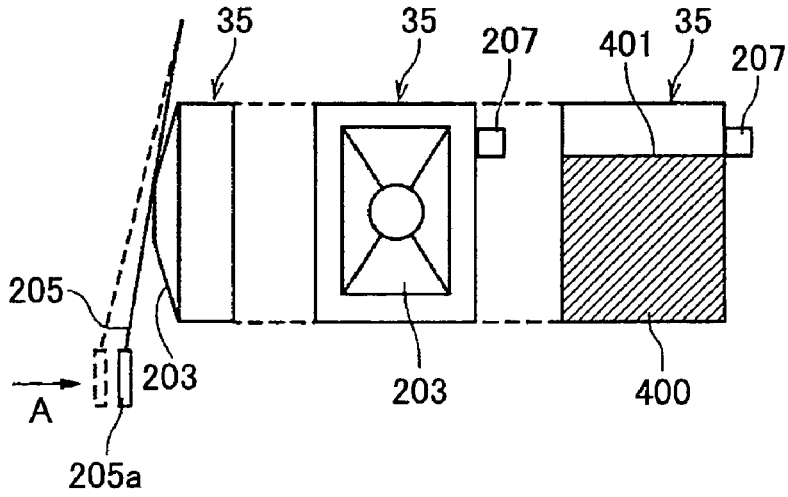

First, if ink is ejected from the sub-tank 35 in a condition of FIG. 11A, the pressure inside the sub-tank 35 is reduced in an amount corresponding to an amount of ink ejected (consumed), and the edge 205*a* of the displacement member (full-tank detecting filler) 205 is moved in the direction indicated by the arrow A (the main-scanning direction) as illustrated in a condition of FIG. 11B. At this moment, although the pressure inside the sub-tank 35 is reduced, a position (level) of the ink surface 401 of the ink 400 remains unchanged.

Figure 11C:
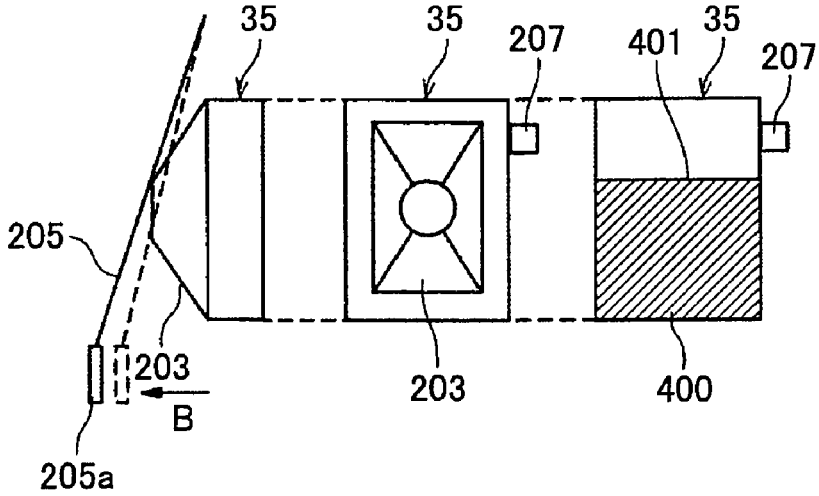

If outside air is introduced inside the sub-tank 35 in the condition of FIG. 11B, the pressure inside the sub-tank 35 is increased in an amount corresponding to the amount of the outside air introduced into the sub-tank 35, and the edge 205*a* of the displacement member (full-tank detecting filler) 205 is moved in a direction indicated by an arrow B (the main-scanning direction) as illustrated in a condition of FIG. 11C. At this moment, although the pressure inside the sub-tank 25 is reduced, a position (level) of the ink surface 401 of the ink 400 remains unchanged.

Figure 11D:
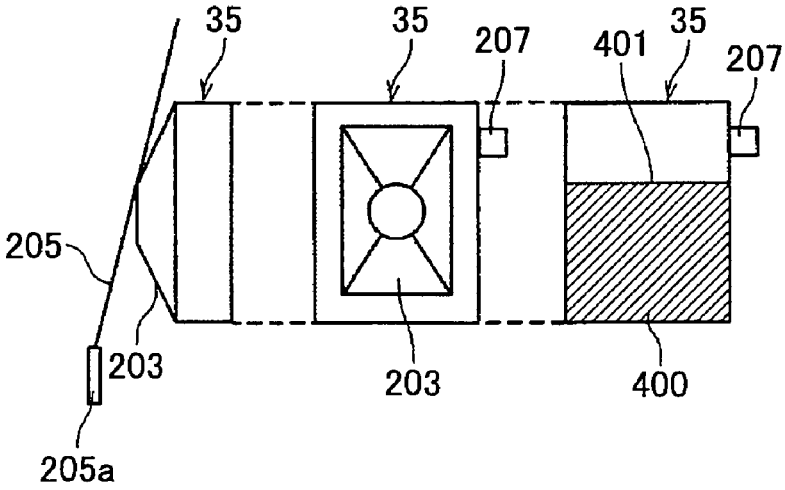

If non-printing ink is ejected from the sub-tank 35 in the condition of FIG. 11C, the pressure inside the sub-tank 35 is reduced in an amount corresponding to an amount of ink ejected (consumed) for the non-printing ink ejection, and the edge 205*a* of the displacement member (full-tank detecting filler) 205 is moved in the direction indicated by the arrow A (the main-scanning direction), which is the direction opposite to that indicated by the arrow B. At this moment, although the pressure inside the sub-tank 35 is reduced, the position (level) of the ink surface 401 of the ink 400 remains unchanged. FIG. 11D illustrates a state when the sub-tank 35 has a normal pressure.

Next, a relationship between the ink use-up urgent printing and a remaining amount of ink in the sub-tank 35 is described with reference to FIGS. 12A and 12B. Note that if the above described steps are repeated, air content inside the sub-tank 35 is gradually increased. Note also that an amount of ink necessary for non-printing ink ejection, which is carried out to reduce the pressure inside the sub-tank 35 in step S5 described above, is predetermined. Thus, if there is no ink remaining in the sub-tank 35 for non-printing ink ejection, the nozzles will not eject ink, which may cause damages in the nozzles. Therefore, a currently remaining amount of ink is computed based on the difference between an amount of ink filled up in the sub-tank 35 (full-tank level) and a consumed amount of ink in the sub-tank 35.

Figure 9:
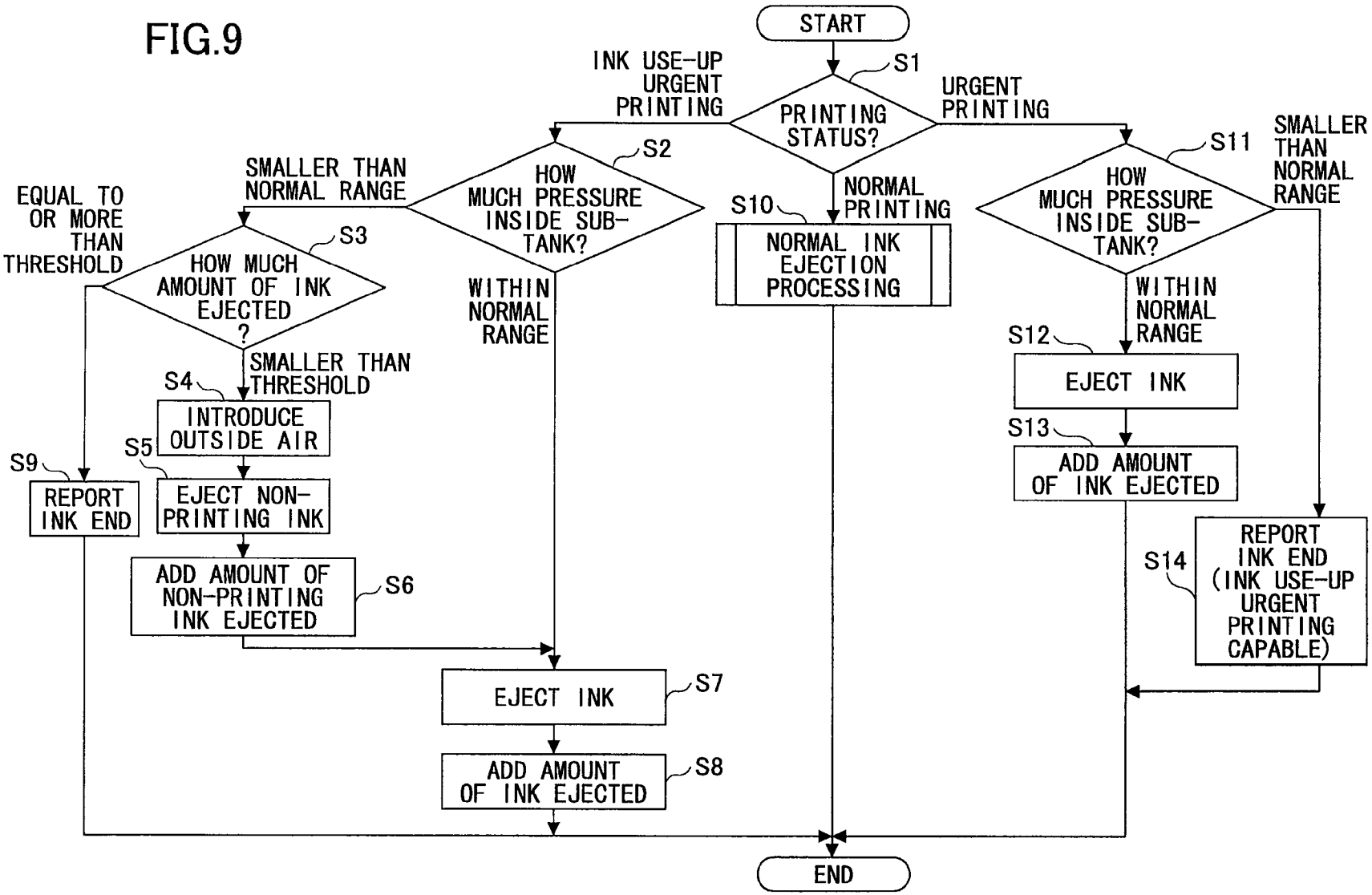
FIG. 9 is a flow diagram illustrating a printing control process carried out by the controller of the image forming apparatus according to the first embodiment.
Figure 12B:
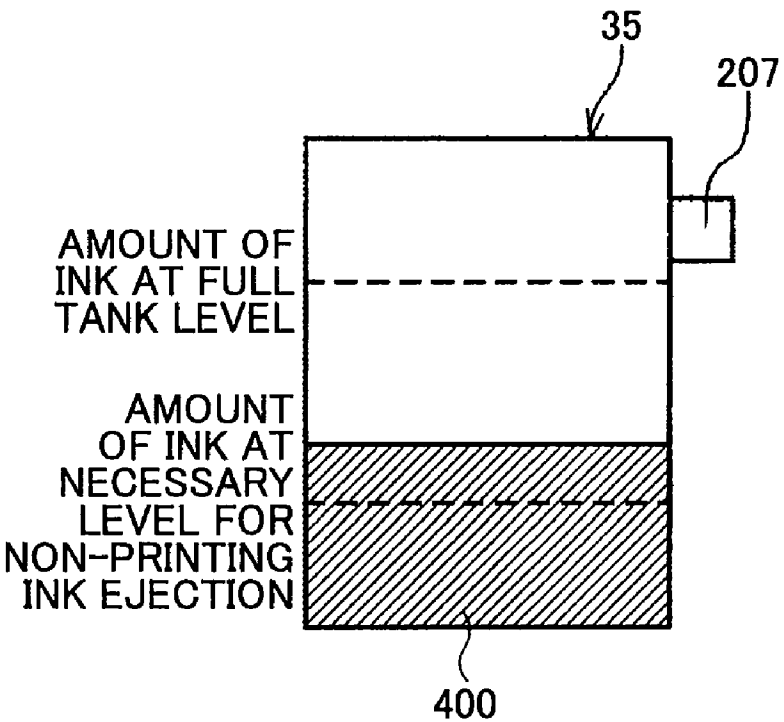
FIGS. 12A and 12B diagrams illustrating a remaining amount of ink in the sub-tank when urgent printing for using up the ink (ink use-up urgent printing) is carried out.
Figure 12A:
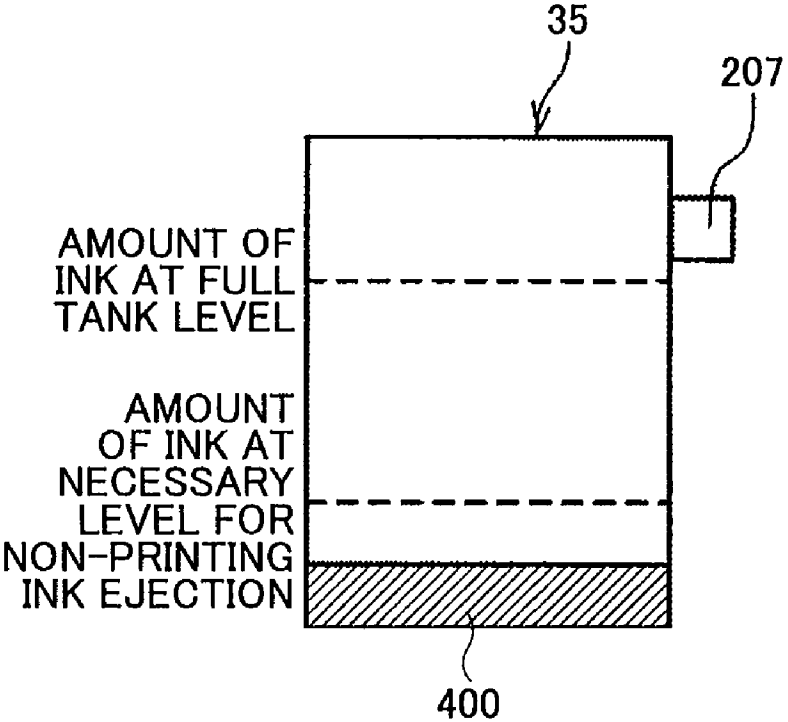

Then, if the remaining amount of ink in the sub-tank 35 is smaller than the amount of ink necessary for non-printing ink ejection as illustrated in FIG. 12A, the ink use-up urgent printing may not be carried out. Accordingly, the ink end status is reported as illustrated in step S9 of FIG. 9.

By contrast, if the remaining amount of ink in the sub-tank 35 is higher than the amount of ink necessary for non-printing ink ejection as illustrated in FIG. 12B, the ink use-up urgent printing may be carried out. Accordingly, the pressure inside the sub-tank 35 increased by introducing outside air into the sub-tank 35 and then reduced by carrying out non-printing ink ejection as illustrated in steps S4 to S8 of FIG. 9.

Next, different positions of the displacement member (full-tank detecting filler) 205 of the sub-tank 35 associated with different ambient temperatures of the image forming apparatus are described with reference to FIGS. 13A through 13C. Note that if the above described steps are repeated, air content inside the sub-tank 35 is gradually increased. The volume of air is largely varied with its temperature, and thus, the pressure inside the sub-tank 35 varies with a change in the ambient temperature of the image forming apparatus. Initially, the ambient temperature of the recording apparatus (image forming apparatus) is detected and the standard temperature is computed as a reference. The position of the displacement member (full-tank detecting filler) 205 is then corrected based on the difference in temperature between the currently detected ambient temperature of the recording apparatus and the reference, so that the displacement member (full-tank detecting filler) 205 is moved to a position where the displacement member (full-tank detecting filler) 205 detects the normal pressure inside the sub-tank 35. Accordingly, the displacement member (full-tank detecting filler) 205 is set to accurately detect the normal pressure inside the sub-tank 35.

Figure 13A:
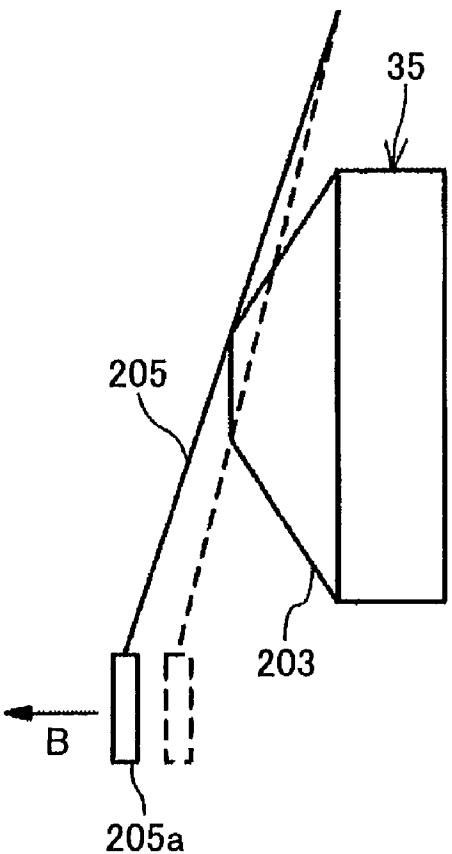
FIGS. 13A through 13C are diagrams illustrating positions of the full-tank detecting filler associated with different ambient temperatures of the image forming apparatus.
Figure 13B:
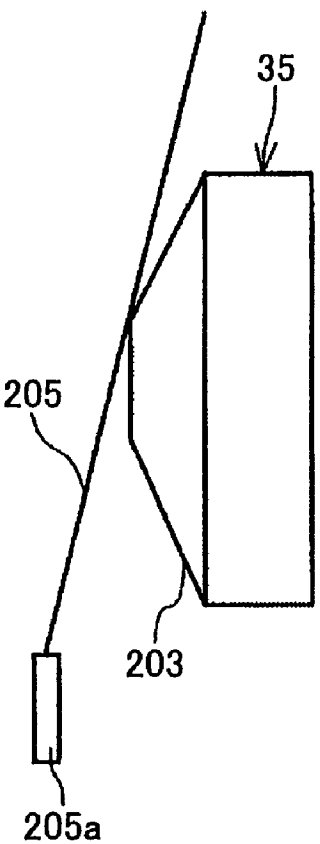

Specifically, if the ambient temperature of the recording apparatus is high as illustrated in FIG. 13A, the volume of air content inside the sub-tank 35 is increased to thereby raise the pressure inside the sub-tank 35. A position of the edge 205*a* of the displacement member (full-tank detecting filler) 205 detected when the volume of the air content detected at the high ambient temperature in FIG. 13A is then compared with the position of the edge 205*a* of the displacement member (full-tank detecting filler) 205 detected when the volume of the air content at the standard temperature illustrated in FIG. 13B. Subsequently, the edge 205*a* of the displacement member (full-tank detecting filler) 205 is moved in a direction indicated by an arrow B (main-scanning direction) as illustrated in FIG. 13A. That is, the detected position (reference position) of the edge 205*a* of the displacement member (full-tank detecting filler) 205 corresponding to the normal pressure inside the sub-tank 35 is corrected in the direction indicated by the arrow B (main-scanning direction) based on the comparison (difference) between the detected ambient temperature (higher than reference) and the reference temperature (i.e., standard ambient temperature).

Figure 13C:
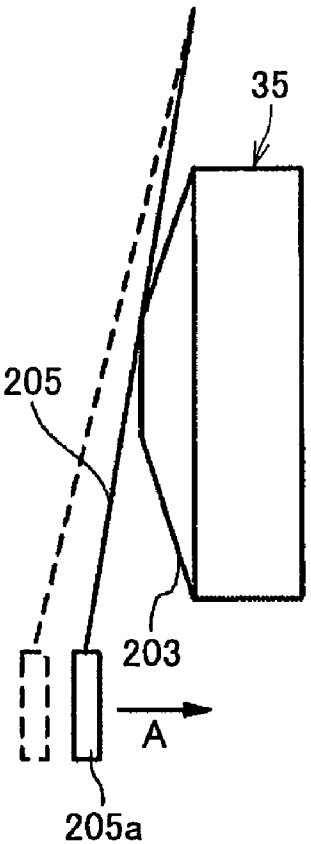

By contrast, if the ambient temperature of the image forming apparatus is low as illustrated in FIG. 13C, the volume of the air content inside the sub-tank 35 is decreased to thereby lower the pressure inside the sub-tank 35. Accordingly, the edge 205*a* of the displacement member (full-tank detecting filler) 205 is moved in a direction indicated by an arrow A (main-scanning direction) as illustrated in FIG. 13C. That is, the detected position (reference position) of the edge 205*a* of the displacement member (full-tank detecting filler) 205 corresponding to the normal pressure inside the sub-tank 35 is corrected in a direction indicated by an arrow A (main-scanning direction) based on the comparison (difference) between the detected ambient temperature (lower than reference) and the reference temperature (i.e., standard ambient temperature).

Accordingly, the image forming apparatus (recording apparatus) according to the first embodiment includes the controller 500 configured to control the image forming operation using the remaining amount of ink in the sub-tank 35 when the main-tank (ink cartridge 10) is at an ink end status. The controller 500 is configured to determine whether the pressure inside the sub-tank 35 detected by the displacement member (full-tank detecting filler) 205 (i.e., pressure detector unit) is within the predetermined normal range. If the detected result of the pressure in the sub-tank 35 is not within the predetermined normal range, the air introducing mechanism 207 of the sub-tank 35 is opened and introduces outside air into the sub-tank 35 to thereby raise the pressure inside the sub-tank 35. Thereafter, the pressure inside the sub-tank 35 is reduced by causing the recording head 34 to carry out non-image forming liquid droplet ejection (non-printing ink ejection), such that the pressure inside the sub-tank 35 falls within the normal range. In this manner, the image forming operation may be carried out using the remaining amount of ink in the sub-tank 35 while maintaining the pressure inside the sub-tank 35 at a level sufficient for ejecting ink droplets. Accordingly, printing may be continued even if the main-tank (i.e., ink cartridge 10) is at the ink end status.

In such a case, the ink use-up urgent printing may cause damage to the image forming apparatus. Accordingly, it is preferable that the ink use-up urgent printing be carried out only when it is externally instructed by the user.

Second Embodiment

Next, an example of an image forming apparatus according to a second embodiment is described with reference to FIGS. 14 to 15. In the image forming apparatus according to the second embodiment, a relationship between a remaining amount of ink inside the sub-tank 35 and an amount of ink necessary for negative pressure generation inside the sub-tank 35 is predetermined. When a negative pressure generating operation is carried out, a remaining amount of ink in the sub-tank 35 is compared with the amount of ink necessary for negative pressure generation. If the remaining amount of ink in the sub-tank 35 is equal to or larger than the amount of ink necessary for negative pressure generation, the controller 500 determines that there is ink remaining in the sub-tank 35, and executes the negative pressure generating operation. However, if the remaining amount of ink in the sub-tank 35 is smaller than the amount of ink necessary for the negative pressure generation, the controller 500 determines that there is no ink remaining in the sub-tank 35 and will not execute the negative pressure generating operation. In this case, the relationship between the remaining amount of ink in the sub-tank and the amount of ink necessary for negative pressure generation inside the sub-tank 35 may be detected based on the number of negative pressure generations counted, and the controller 500 may determine that the ink end status when the counted number of negative pressure generations reaches a predetermined number of negative pressure generations.

Figure 14B:
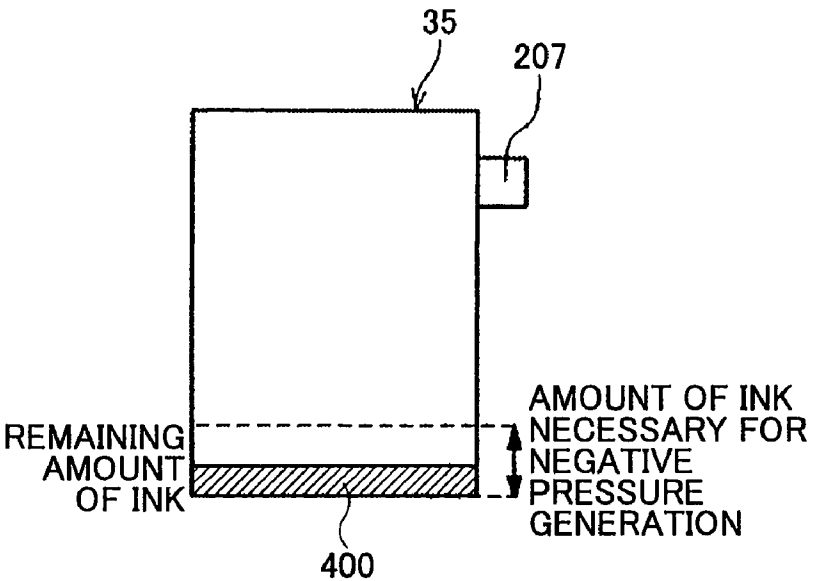
FIGS. 14A and 14B diagrams illustrating remaining amounts of ink and associated ink amounts necessary for generating negative pressures in the sub-tank placed in a mechanical unit of an image forming apparatus according to a second embodiment.
Figure 14A:
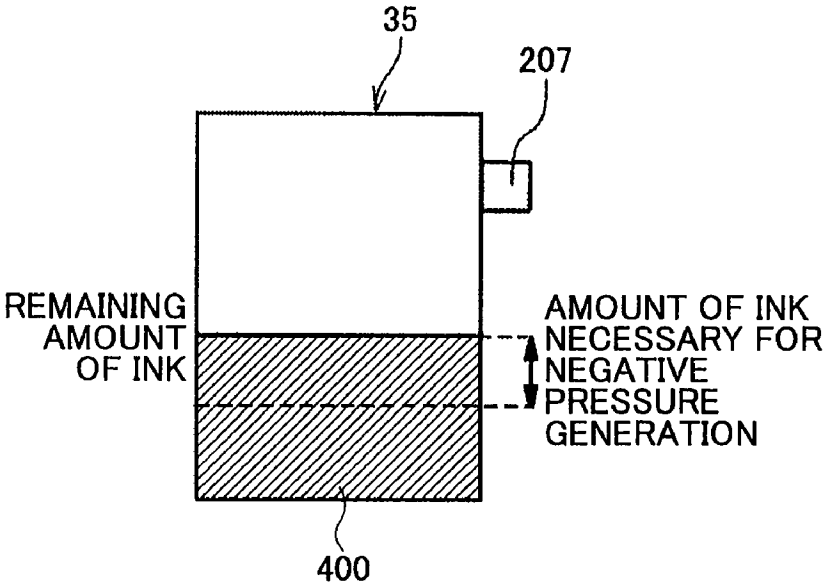

That is, as illustrated in FIG. 14A, in order to generate a negative pressure inside the sub-tank 35 by carrying out the non-printing ink ejection, the remaining amount of ink in the sub-tank 35 needs to be equal to or larger than the amount of ink necessary for negative pressure generation inside the sub-tank 35. When the amount of ink necessary for negative pressure generation is smaller than the remaining amount of ink inside the sub-tank 35 as illustrated in FIG. 14B but the non-printing ink ejection is still carried out, ink inside the sub-tank 35 is completely empty. If the ink inside the sub-tank 35 is completely empty (run out), the internal nozzles may be clogged with foam. Accordingly, it may be difficult to recover the nozzles even if new ink is supplied by replacing the ink cartridge with a new one.

Thus, in the second embodiment, in order to prevent the sub-tank 35 from being completely running out (i.e., being completely empty), the remaining amount of ink inside the sub-tank 35 is monitored and the remaining amount of ink inside the sub-tank 35 us compared with the amount of ink necessary for negative pressure generation.

Figure 15:
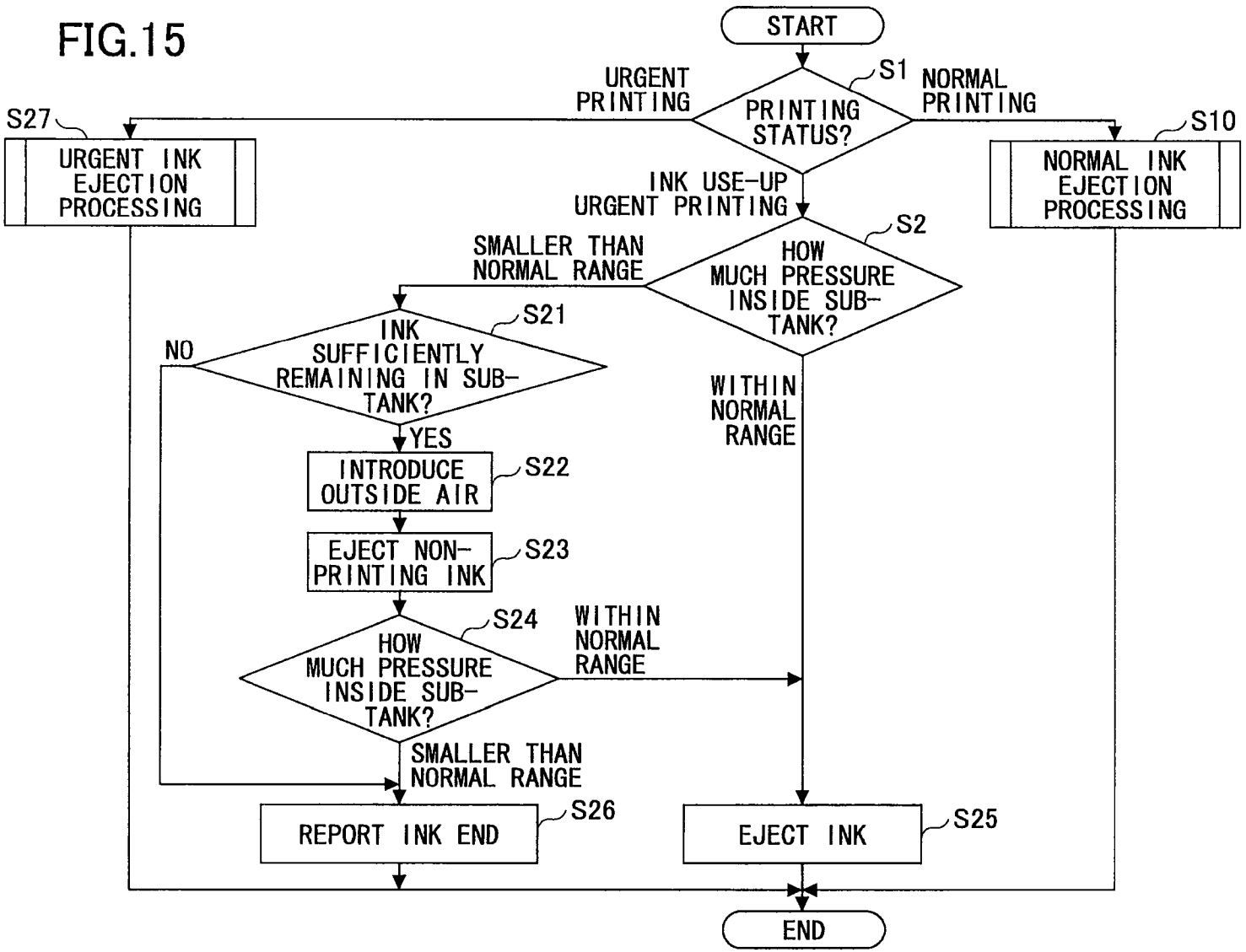
FIG. 15 is a flow diagram illustrating a printing control process carried out by a controller of the image forming apparatus according to the second embodiment.

Specifically, as illustrated in FIG. 15, if the pressure inside the sub-tank 35 is smaller than the normal range while carrying out ink use-up printing, whether the amount of ink (inside the sub-tank 35) necessary for negative pressure generation is equal to or larger than the remaining amount of ink inside the sub-tank 35 is determined (step S21).

In this process, if some amount of ink is remained in the sub-tank 35 ("YES" in step S21), the air introducing mechanism 207 of the sub-tank 35 is opened and introduces outside air to the sub-tank 35 to thereby raise the pressure inside the sub-tank 35, and the air introducing mechanism 207 is then closed (step S22). Thereafter, the recording head 34 carries out non-image forming liquid droplet ejection (non-printing ink ejection) to reduce the pressure inside the sub-tank 35 (step S23). Subsequently, whether the pressure inside the sub-tank 35 is within the normal range is determined (step S24). If the pressure inside the sub-tank 35 is within the normal range, printing operation (image forming operation) is carried out by ink ejection (step S25).

By contrast, if no amount of ink is remained in the sub-tank 35 ("NO" in step S21), and the pressure inside the sub-tank 35 is, despite generation of the negative pressure, not within the normal range but is smaller than the normal range, the result determined as the "ink end status" is reported to the operations panel 514 or the host side 600 (step S26).

The urgent printing processing (step S27) is the same as that of the first embodiment, and the description is thus omitted.

Note that the "ink end status" may be reported via a display device such as the operations panel 514 attached to the main body of the image forming apparatus, a status monitor displayed on an external information processing apparatus such as a PC, and an alert report via email.

Figure 16:
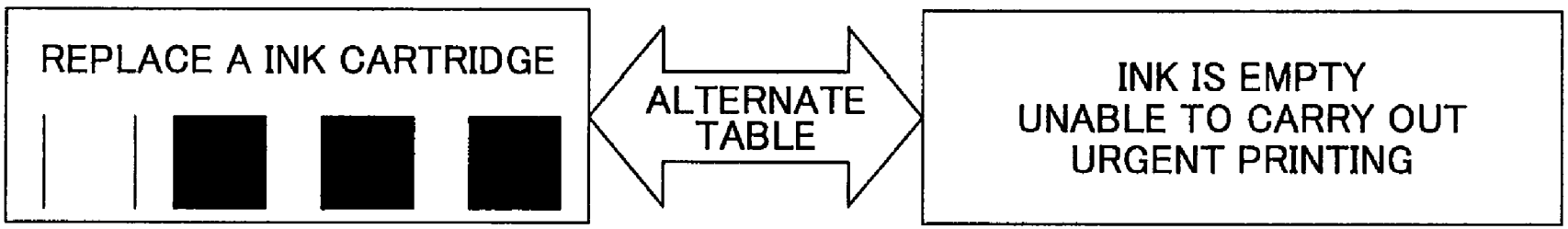
FIG. 16 is a view illustrating an example of an error massage report displayed on a main body of the image forming apparatus.

FIG. 16 illustrates an example of an ink end status report (messages) displayed on the operations panel 514 of the image forming apparatus. With this message (display) on the operations panel 514, the image forming apparatus status is reported to the user, and the user is prompted to replace the ink cartridge.

Figure 17:
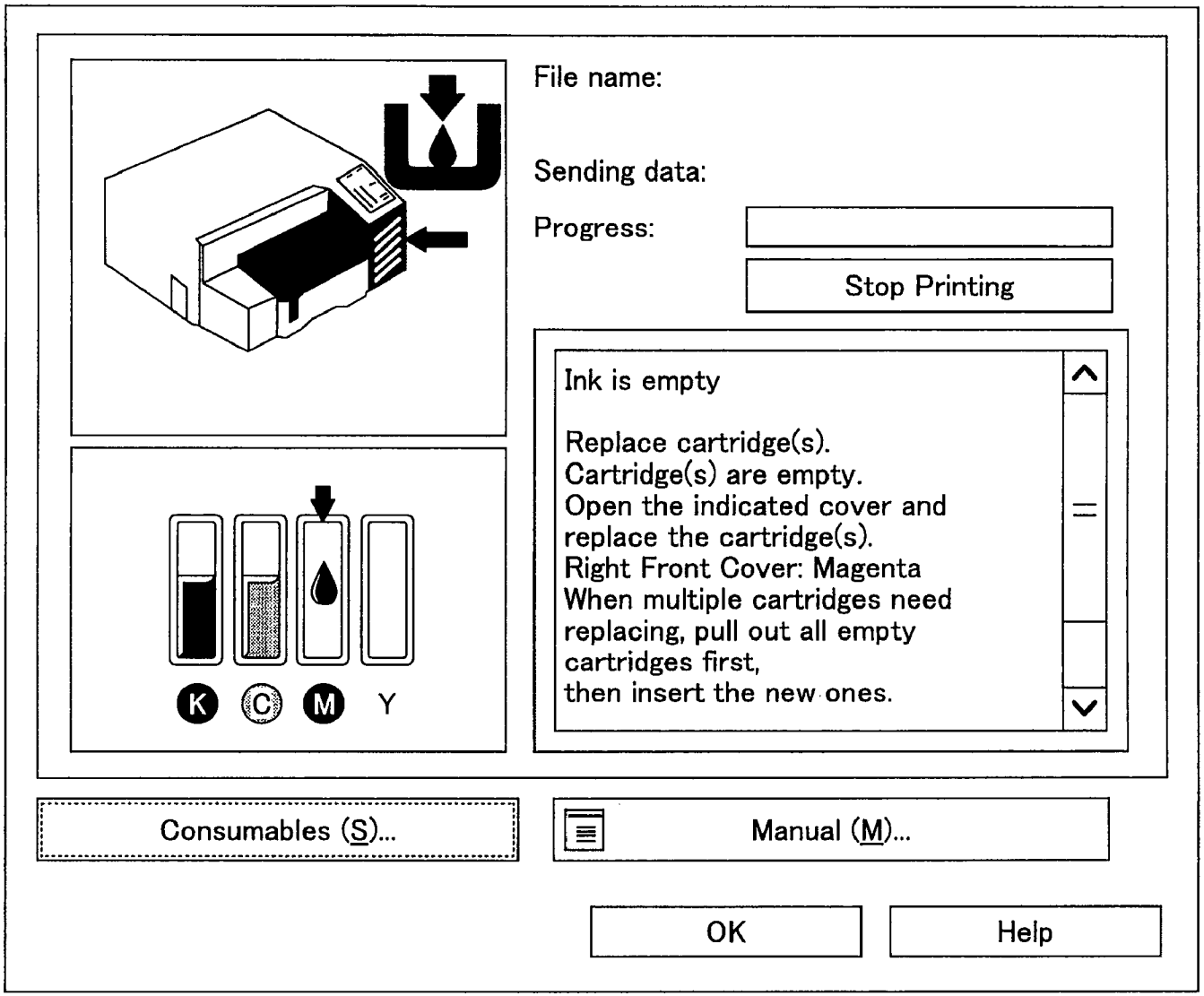
FIG. 17 is a view illustrating an example of an error massage report displayed on an external apparatus.

FIG. 17 illustrates another example of the ink end report (messages) displayed on the status monitor of the PC.

With this method, even if the user is not nearby the image forming apparatus (recording apparatus), the apparatus status is still reported to the user, and the user is prompted to replace the ink cartridge.

FIG. 18 illustrates another example of the ink end report (messages) sent via the email. As illustrated in FIG. 18, the ink end report (messages) is sent to an apparatus administrator via the email with the format depicted in FIG. 18 to prompt the administrator to replace the ink cartridge.

Figure 19:
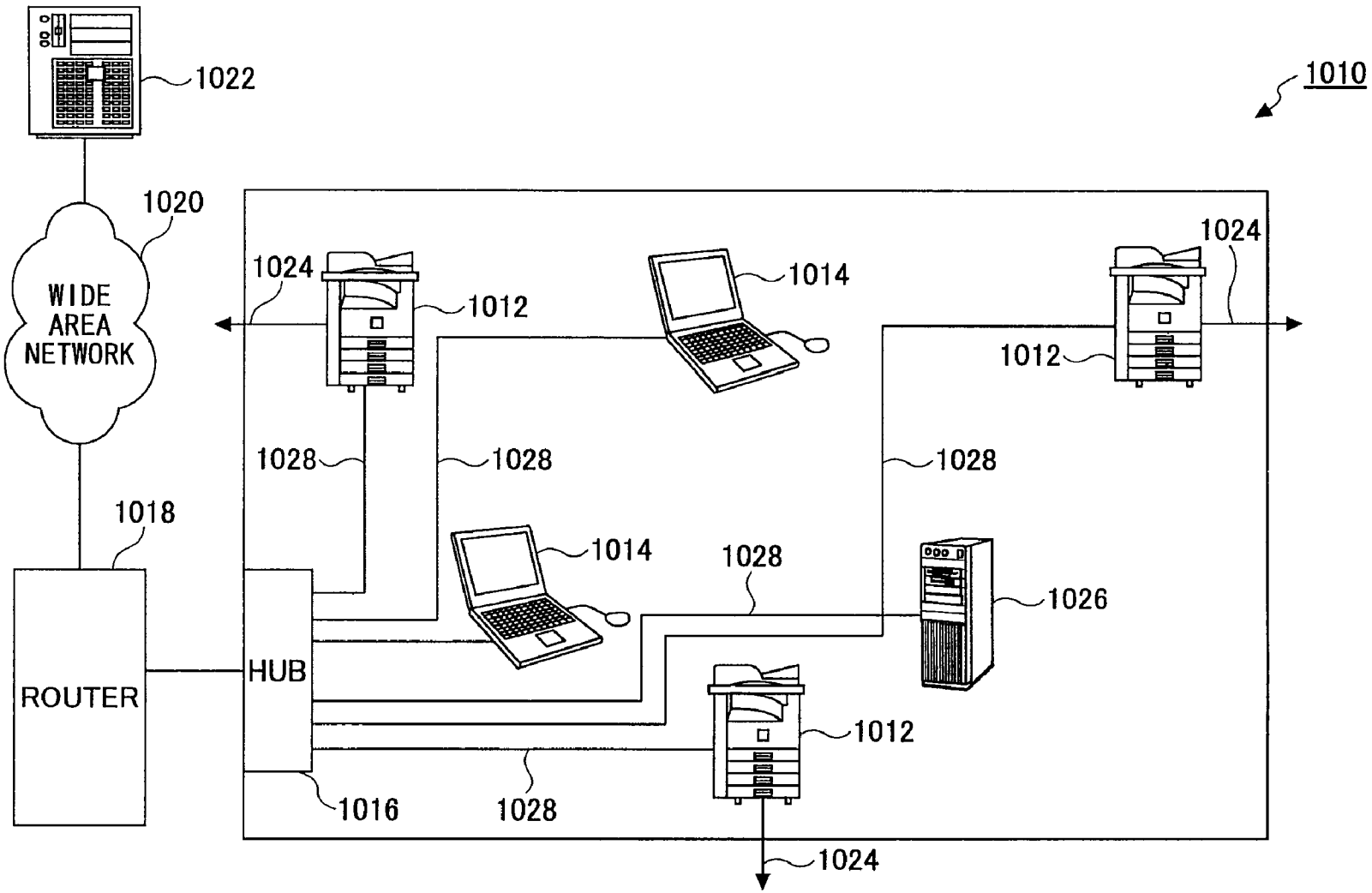
FIG. 19 is a diagram illustrating an example of an office floor network system including the image forming apparatus according to the embodiments.

Next, an example of an office floor network system including the image forming apparatus is described with reference to FIG. 19. A network system 1010 includes image forming apparatuses 1012, information processing apparatuses 1014, and a server 1026 mutually connected via a local area network (LAN) 1028 such as Ethernet (registered trademark). The image forming apparatuses 1012, the server 1026 and the information processing apparatuses 1014 are physically connected to the LAN 1028 via a hub 1016 so that they are mutually communicated one another based on their media access control address (MAC) addresses and IP addresses.

The hub 1016 is further connected to a router 1018, which connects the image forming apparatuses 1012, the information processing apparatuses 1014, and the server 1026 to a wide area network (WAN) 1020 such as the Internet. The wide area network 1020 is connected to a POP server 1022, which enables the image forming apparatuses 1012, the information processing apparatuses 1014 and the server 1026 to mutually communicate emails based on the SMTP protocol. Note that the wide area network 1020 may also be connected by a web server. The POP server 1022 may be implemented as a mail server provided by an ISP, or implemented as a dedicated mail server located in an internal office.

The image forming apparatuses 1012 have multifunctional services such as a facsimile function, a copier function, a printer function, and an auto reverse document feeder (ARDF) function so that the image forming apparatuses 1012 carry out job requests sent from the information processing apparatuses 1014 or directly instructed by the users, or carry out processing on facsimile data received via a public switched telephone network (PSTN) to perform image formation.

The image forming apparatuses 1012 further include the operations panels (not shown in FIG. 19) having LCD panels so that the users can set various settings via the operation panels. The auto reverse document feeder (ARDF) function activates its motor to feed a document placed on a document board to a scanner for scanning the document and further activates an optical emitting system, a driving motor, and a CCD to convert the scanned document data into digital document data.

The image forming apparatuses 1012 each further include not shown controller and printer engine to manage image formation. The controller includes a CPU (not shown) operable as an operating system (OS) such as a UNIX (registered trademark), a LINUX (registered trademark), and a Windows (registered trademark) 200X. The controller further provides part of the functions of the web server under the above OS by executing application programs written by programming languages such as C, C++, JAVA (registered trademark), Perl, and server programs such as Apache and Servlets. The controller further includes, though not shown in FIG. 19, a storage managing unit, a communication processing unit, and an image converting unit. The storage managing unit is configured to carryout input and output management of the storage device such as an SDRAM or a hard disk drive device. The communication processing unit is configured to decode the data received from a facsimile modem having communication rates of 56 Kbps or 126 Kbps using a coding system such as run-length coding, MR coding, and MMR coding based on a protocol such as an ITU-T recommendation T.6 or code the data to send faxes from the image forming apparatus 1012. The communication processing unit further manages data communications based on IP protocol suites and TCP/IP or UDP/IP.

The communication processing unit receives a data communication request from the application program contained in the controller, creates IP packets or frames and sends the data from a network interface card (NIC) to Ethernet (registered trademark) or a wireless LAN, or sends the data to the application program. Note that the communication processing unit is configured to support a data connection protocol such as a point to point protocol (PPP) and PPP on Ethernet (registered trademark) for executing the above processing.

The image converting unit is configured to convert the data acquired by the image forming apparatus 1012 into image data such as GIF, JPEG, JPEG 2000, TIFF, and PNG, create PDL (page description language) based on the converted data, and send the created PDL to the printer engine, thereby forming images. The controller further includes a flash ROM to manage setup data for starting up the image forming apparatus 1012 or color conversion data used for image formation. The controller further includes an UDB controller to manage an USB host (now shown) via the USB or a bus connection between the printer engine and the image forming apparatus 1012. Note that the USB controller may support an UWB protocol defined by IEEE802.15. The image forming apparatus 1012 includes a power supply unit (PSU) to carry out power supply management for the image forming apparatus 1012.

The printer engine is configured to carry out image formation based on an inkjet recording system. The printer engine also supports a printer job language (PJL) for carryout printing in response to a print request received from outside.

The storage device such as the SDRAM is configured to manage plural data sets. The plural data sets include a set of registered source address data (SUC_ADDR: source_Address), a set of registered acknowledgement address data (ACK_ADDR: acknowledge_Address), and a management information base (MIB). The set of registered source address data is preliminary set by the user and is configured to determine whether to receive a report on the received facsimile data. The set of registered source address data is registered with a facsimile number format. The set of registered acknowledgement address data includes registered acknowledgement address data of corresponding users. The set of registered acknowledgement address data may be registered with various formats such as formats of an email address for sending reported messages by a mailer, the MAC address, the IP address (a local domain defined by private address/subnet mask), and a terminal name. If the MAC address or IP address is used as the registered acknowledgement address data, it is preferable to include a correspondence table including terminal names or user identifiers and MAC addresses or IP addresses associated with the corresponding terminal names or user identifiers for facilitating the users inputting operations. Further, when a NetBIOS (Network Basic Input/Output System) is used as a network base instead of TCP/IP, a lookup table having the IP addresses and their associated MAC addresses registered based on terminal names is used as set of the registered acknowledgement address data.

The MIB is a data set for registering network management information including the MIB-1 defined as the RFC 1156 or the MIB-2 defined as the RFC 1213, and is used for managing the status of the image forming apparatus based on object identifiers (OIDs) and their corresponding associated status data.

Note that the information processing apparatuses 1014 and the server 1026 are information processing apparatuses dedicated to servers such as personal computers, workstations, blade servers, and thin servers. The information processing apparatus 1014 sends the result processed by the application software to the image forming apparatus 1012 via the printer driver so that the image forming apparatus 1012 displays the processed result. If the server 1026 is served as the printer server, the server 1026 receives a print request from the image forming apparatus 1014 and sends appropriate print jog instruction to the image forming apparatus 1012.

Third Embodiment

Figure 20:
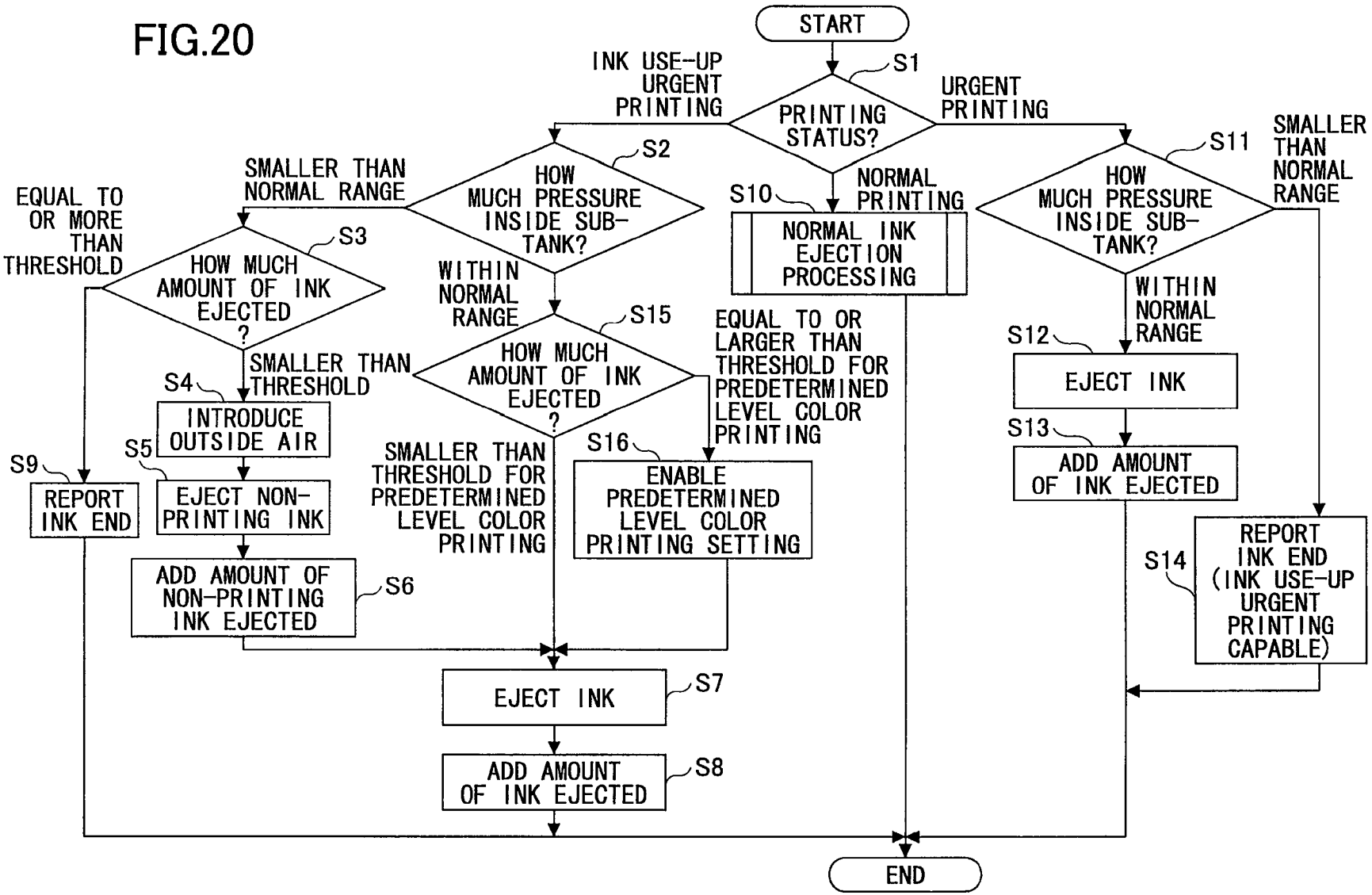
FIG. 20 is a flow diagram illustrating a printing control process carried out by a controller of an image forming apparatus according to a third embodiment.

Next, an example of an image forming apparatus according to a third embodiment is described with reference to FIG. 20. Note that FIG. 20 is a flow diagram illustrating a printing control process carried out by the controller 500 of the image forming apparatus according to the third embodiment. In the third embodiment, if the amount of ink ejected (i.e., consumed amount of ink) is equal to or larger than a predetermined threshold, the ink use-up printing is carried out using the amount of ink smaller than the amount of ink consumed in the normal image forming operation (i.e., normal printing). Note that the ink use-up printing carried out using the amount of ink smaller than the amount of ink consumed in the normal image forming operation is called a "predetermined level color printing" and the predetermined threshold is set for determining whether to carry out the predetermined level color printing.

Note also that the predetermined level color printing includes processing of reducing the amount of ink or reducing grayscale of the image data. Specifically, the predetermined level color printing includes uniformly reducing the amounts of ink of four colors or uniformly reducing grayscale of the image data, or changing the reducing amount of ink corresponding to objects of the image data. For example, the amount of ink is not reduced for printing of text data but reduced for printing of image data and graphical data. Note also that the predetermined level color printing is carried out by changing parameters for color conversion processing that changes an input color space of the images into an output color space of the images. Note also that the predetermined level color printing, in which the consumed amount of ink is used smaller than that of the normal printing, may be carried out by simple pixel (dot) skipping and changing a y correction value. That is, the predetermined level color printing may be carried out by any operations insofar as the consumed amount of ink (ejected ink) is smaller than that of the normal printing operation.

Specifically, as described in the printing control process in the second embodiment, if the pressure inside the sub-tank 35 is within the normal range (step S2 see also FIG. 9), whether the consumed amount of ink (ejected ink) is equal to or larger than the predetermined threshold for carrying out the predetermined level color printing (step S15) as illustrated in FIG. 20.

When the amount of ejected ink is larger than the threshold for the predetermined level color printing, a predetermined level color printing setting is enabled (step S16).

In this manner, the predetermined level color printing is carried out for the ink use-up printing so that the consumed amount of ink consumed in the predetermined level color printing is smaller than that of the normal printing.

Note that step S15 of determining whether the consumed amount of ink (ejected ink) is equal to or larger than the threshold for the predetermined level color printing and step S16 of determining whether to enable the predetermined level color printing setting may be carried out subsequently to step S6.

Figure 21:
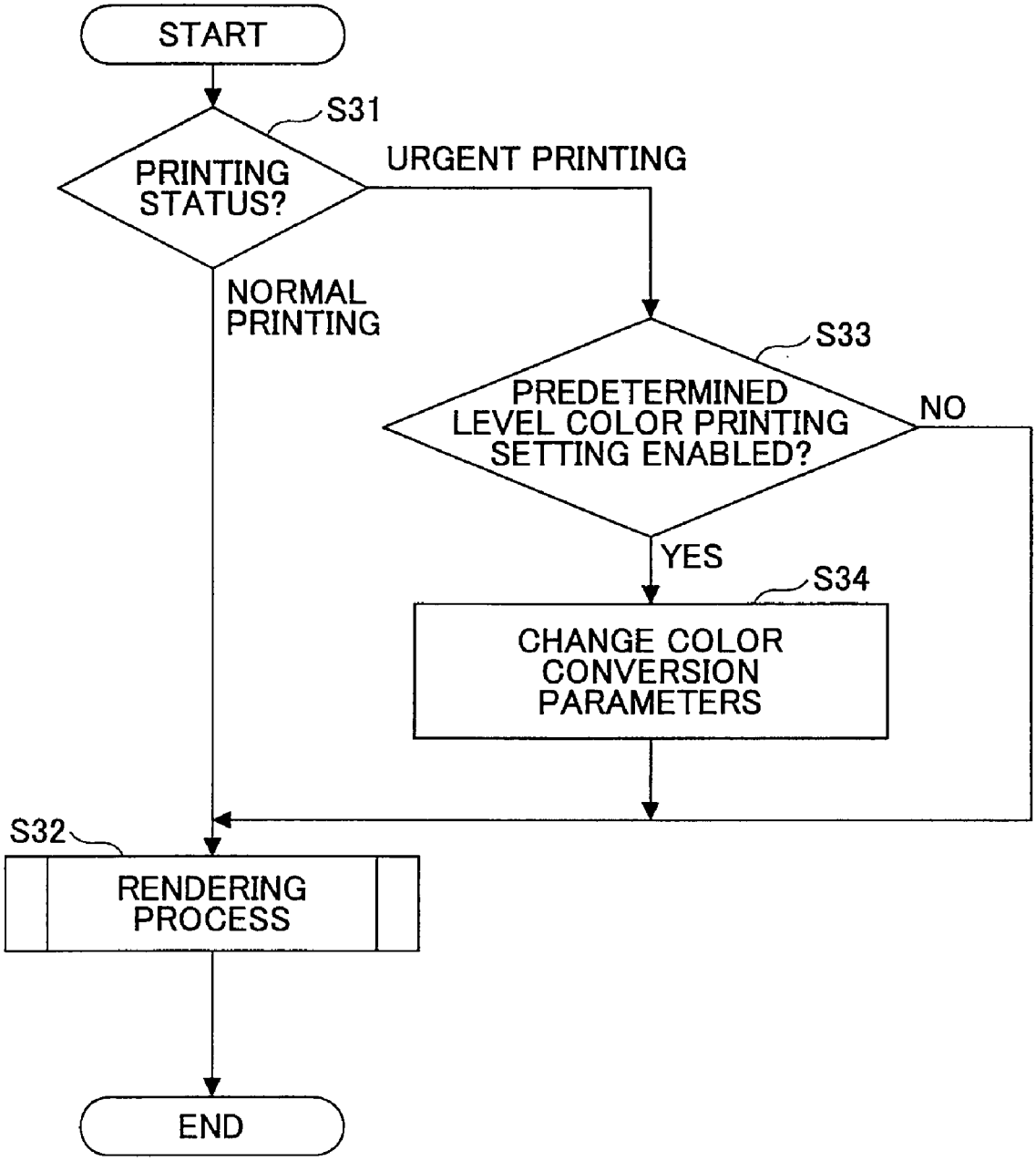
FIG. 21 is a flow diagram illustrating a predetermined level color printing process for urgent printing.

Next, an example of a predetermined level color printing process for the urgent printing are described with reference to FIG. 21. Initially, whether the current status of printing is normal printing or urgent printing is determined (step S31). If the current status of printing is the normal printing, an input byte stream is directly analyzed, thereby generating printing image data (a rendering process: step S32).

By contrast, if the current status of printing is the urgent printing, whether the predetermined level color printing setting is enabled is determined (step S33). If the predetermined level color printing setting is enabled, the color converting parameters are changed into those for the predetermined level color printing (step S34). Thereafter, the input byte stream is analyzed, thereby generating printing image data (rendering process: step S32). Note that if the predetermined level color printing setting is non-enabled, printing image data are directly generated (the rendering process: step S32) without the change in the color converting parameters.

Figure 22:
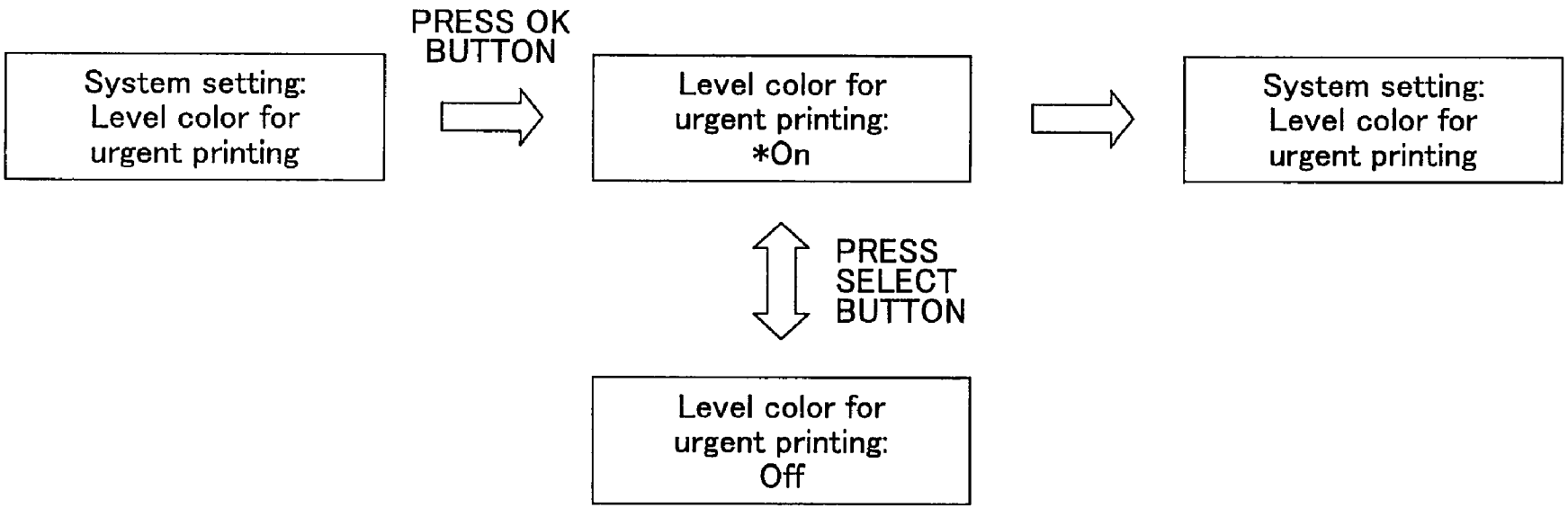
FIG. 22 is a diagram illustrating an example of a level color printing setting displayed on the main body of the image forming apparatus.

FIG. 22 illustrates an example of the level color printing setting displayed on the main body of the image forming apparatus. This example illustrates a ON/OFF setting for carrying out the predetermined level color printing for the urgent printing.

Figure 8:
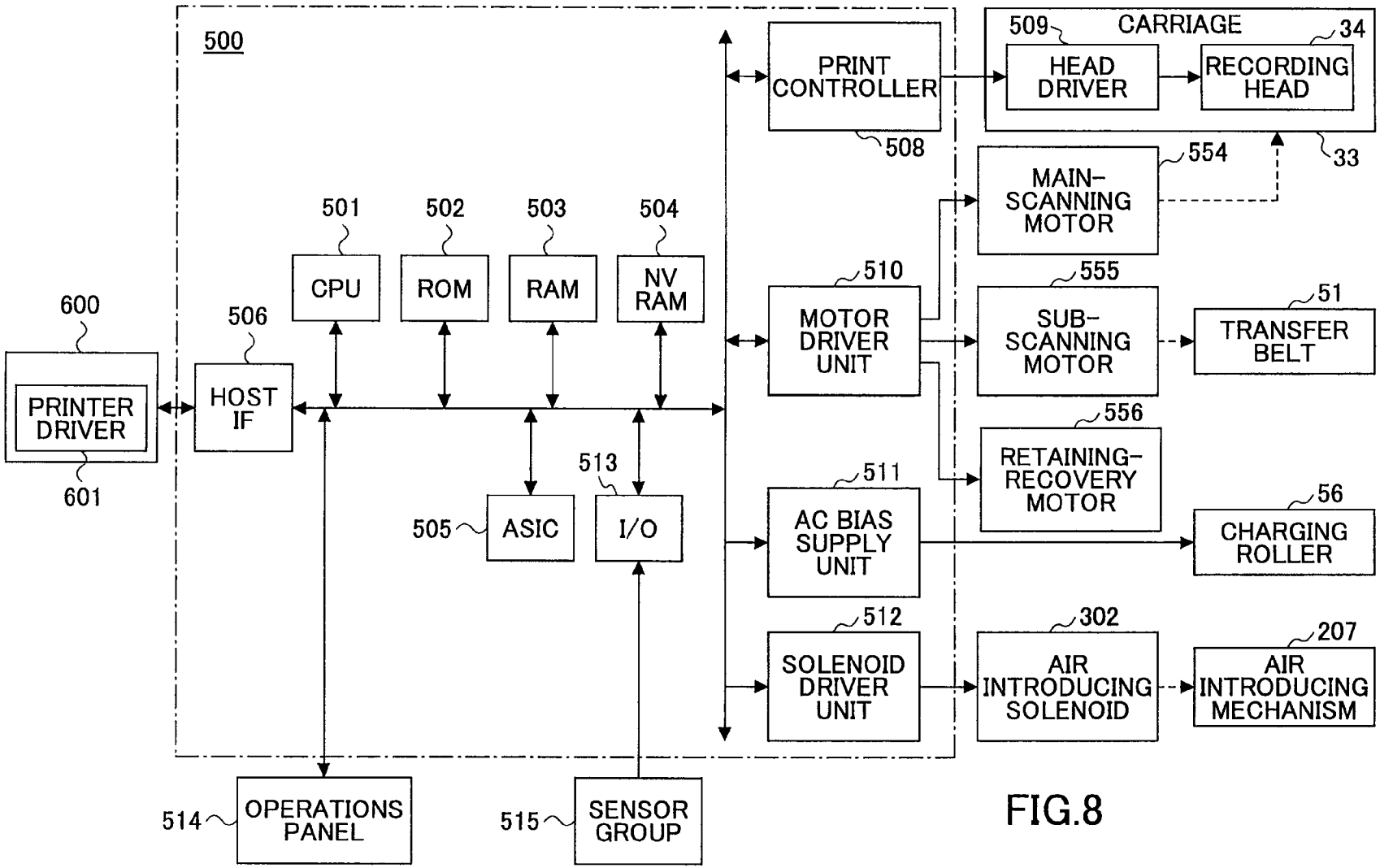
FIG. 8 is a schematic block diagram illustrating a controller of the image forming apparatus according to the first embodiment.

The above-described processes including a control process for the sub-tank ink use-up urgent printing, a sub-tank pressure detecting process, and a measuring process for measuring consumed amount of ink are implemented by causing a computer to execute a computer program having sets of instructions stored in the ROM 502 (see FIG. 8). The computer program may be downloaded to the information processing apparatus side (host side 600, see FIG. 8) and installed in the image forming apparatus via the host side 600. The above-described processes may be carried out by the printer driver the information processing apparatus side (host side 600, see FIG. 8) and installed in the image forming apparatus via the host side 600. Further, the image forming apparatuses according to the first to third embodiments and the information processing apparatuses or the image forming apparatuses according to the first to third embodiments and the information processing apparatuses containing the computer programs for carrying out the above-described processes may be combined to constitute an image forming system.

The image forming apparatus according to the first to third embodiments includes the main-tank 10 configured to supply ink, the sub-tank 35 configured to acquire the ink from the main-tank, and the controller 500 configured to control the image forming operation using the remaining amount of ink in the sub-tank 35 while the main-tank (ink cartridge 10) is at an end status. The controller 500 is configured to determine whether the pressure inside the sub-tank 35 detected by the displacement member (full-tank detecting filler) 205 (i.e., pressure detector unit) is within the predetermined normal range. If the detected result of the pressure in the sub-tank 35 is not within the predetermined normal range, the air introducing mechanism 207 of the sub-tank 35 is opened and introduces outside air into the sub-tank 35 to thereby raise the pressure inside the sub-tank 35. Thereafter, the pressure inside the sub-tank 35 is reduced by causing the recording head 34 to carry out non-image forming liquid droplet ejection (non-printing ink ejection), such that the pressure inside the sub-tank 35 falls within the normal range. In this manner, the image forming operation may be carried out using the remaining amount of ink in the sub-tank 35 while maintaining the pressure inside the sub-tank 35 at a level sufficient for ejecting ink droplets. Thus, printing may be continued even if the main-tank (i.e., ink cartridge 10) is at the ink end status.

Embodiments of the present invention have been described heretofore for the purpose of illustration. The present invention is not limited to these embodiments, but various variations and modifications may be made without departing from the scope of the present invention. The present invention should not be interpreted as being limited to the embodiments that are described in the specification and illustrated in the drawings.

The present application is based on Japanese priority application No. 2009-210727 filed on Sep. 11, 2009, and Japanese priority application No. 2010-003459 filed on Jan. 9, 2010, with the Japanese Patent Office, the entire contents of which are hereby incorporated by reference.

What is claimed is:

1. An image forming apparatus comprising:

a recording head configured to eject liquid droplets;

a sub-tank having a liquid container configured to store an amount of a liquid to be supplied to the recording head, a negative pressure generator unit configured to generate a negative pressure inside the sub-tank and an air introducing mechanism configured to introduce outside air into the liquid container;

a main-tank containing the liquid and configured to supply the amount of the liquid into the sub-tank;

a pressure detector unit configured to detect a pressure inside the sub-tank; and a controller configured to control an image forming operation using a remaining amount of the liquid in the sub-tank while the main-tank is at an end status, wherein the controller determines whether the pressure inside the sub-tank detected by the pressure detector unit is within a predetermined normal range, causes, if the detected result of the pressure inside the sub-tank is not within the predetermined normal range, the air introducing mechanism of the sub-tank to open and introduce outside air into the sub-tank to raise the pressure inside the sub-tank, and causes the recording head to carry out non-image forming liquid droplet ejection to control a negative pressure generating operation to cause the pressure inside the sub-tank to fall within the normal range.

2. The image forming apparatus as claimed in claim 1, wherein the controller includes a liquid consumption measuring unit configured to measure a consumed amount of the liquid ejected from the recording head, and determines a status of the main-tank as the end status when the consumed amount of the liquid ejected from the recording head measured by the liquid consumption measuring unit is equal to or larger than a predetermined value.

3. The image forming apparatus as claimed in claim 1, wherein a controller carries out, on receiving an instruction to carry out the image forming operation using the remaining amount of the liquid in the sub-tank while the main-tank is at the end status, the image forming operation using the remaining amount of the liquid in the sub-tank while the main-tank is at the end status based on the received instruction.

4. The image forming apparatus as claimed in claim 1, further comprising:

a corrector unit configured to detect an ambient temperature of the image forming apparatus and correct the pressure inside the sub-tank detected by the pressure detector unit based on the detected temperature, wherein the controller determines whether the pressure inside the sub-tank detected by the pressure detector unit is within the predetermined normal range, causes, if the detected result of the pressure inside the sub-tank is not within the predetermined normal range, the corrector unit to correct the pressure inside the sub-tank detected by the pressure detector unit based on the detected temperature such that the pressure inside the sub-tank falls within the normal range.

5. The image forming apparatus as claimed in claim 1, further comprising a remaining liquid detector unit configured to detect a remaining amount of the liquid in the sub-tank, wherein if the detected result of the pressure inside the sub-tank is not within the predetermined normal range, the controller compares the remaining amount of the liquid in the sub-tank detected by the remaining liquid detector unit with a predetermined amount of the liquid necessary for the negative pressure generation inside the sub-tank, and wherein if the remaining amount of the liquid in the sub-tank detected by the remaining liquid detector unit is equal to or larger than the predetermined amount of the liquid necessary for the negative pressure generation inside the sub-tank, the controller causes the recording head to carryout the non-image forming liquid droplet ejection to control the negative pressure generating operation to cause the pressure inside the sub-tank to fall within the normal range.

6. The image forming apparatus as claimed in claim 5, wherein if the remaining amount of the liquid in the sub-tank detected by the remaining liquid detector unit is smaller than the predetermined amount of the liquid necessary for the negative pressure generation inside the sub-tank, the controller reports an error.

7. The image forming apparatus as claimed in claim 1, wherein an ejecting amount of the liquid for the image forming operation consumed from the remaining amount of the liquid in the sub-tank while the main-tank is at the end status is lower than an ejecting amount of the liquid therefor consumed from the remaining amount of the liquid in the sub-tank while the main-tank is not at the end status.

8. A computer-readable recording medium having a computer program embedded therein for causing a computer to execute method steps of an image forming apparatus, the image forming apparatus having a main tank containing a liquid and a sub-tank, the method comprising:

supplying an amount of the liquid into the sub-tank from the main-tank;

detecting a pressure inside the sub-tank; and controlling an image forming operation using a remaining amount of the liquid in the sub-tank while the main tank is at an end status, wherein the controlling step further includes determining whether the detected pressure inside the sub-tank is within a predetermined normal range, opening, if the detected result of the pressure inside the sub-tank is not within the predetermined normal range, an air introducing mechanism of the sub-tank to introduce outside air into the sub-tank to raise the pressure inside the sub-tank, and causing a recording head to carry out non-image forming liquid droplet ejection to control a negative pressure generating operation to cause the pressure inside the sub-tank to fall within the normal range.

* * * * *